US005566071A

United States Patent [19]

Akazaki et al.

[11] Patent Number: 5,566,071

[45] Date of Patent: Oct. 15, 1996

[54] AIR/FUEL RATIO ESTIMATION SYSTEM FOR INTERNAL COMBUSTION ENGINE

[75] Inventors: Shusuke Akazaki; Yusuke Hasegawa; Yoichi Nishimura; Isao Komoriya, all of Wako, Japan

[73] Assignee: Honda Giken Kogyo Kabushiki Kaisha, Tokyo, Japan

[21] Appl. No.: 383,216

[22] Filed: Feb. 3, 1995

[30] Foreign Application Priority Data

Feb. 4, 1994 [JP] Japan ..... 6-033201
Feb. 4, 1994 [JP] Japan ..... 6-033203

[51] Int. Cl.[6] ..... G06G 7/70; F02D 41/14

[52] U.S. Cl. ..... 364/431.05; 364/431.03; 364/431.04; 60/274; 60/275; 60/276; 60/285; 123/692; 123/673; 123/672

[58] Field of Search ..... 364/431.05, 431.04, 364/431.08, 431.01; 60/276, 277, 285; 123/703, 486, 492, 674, 419, 436, 681, 694, 673, 489

[56] References Cited

U.S. PATENT DOCUMENTS

| | | | |
|---|---|---|---|
| 4,061,117 | 12/1977 | Ikeura | 60/276 |
| 4,766,870 | 8/1988 | Nakajima et al. | 123/674 |
| 4,915,079 | 4/1990 | Holmes | 123/419 |
| 4,962,741 | 10/1990 | Cook et al. | 123/489 |
| 5,022,225 | 6/1991 | Sawada et al. | 60/274 |
| 5,024,199 | 6/1991 | Abe | 123/489 |
| 5,158,063 | 10/1992 | Hosoda et al. | 123/676 |
| 5,207,057 | 5/1993 | Kayanuma | 60/276 |
| 5,363,648 | 11/1994 | Akazaki et al. | 60/276 |
| 5,377,654 | 1/1995 | LoRusso et al. | 123/673 |
| 5,394,691 | 3/1995 | Seki | 60/276 |
| 5,448,978 | 9/1995 | Hasegawa et al. | 123/480 |
| 5,462,037 | 10/1995 | Hasegawa et al. | 123/604 |
| 5,465,703 | 11/1995 | Abe | 123/674 |

FOREIGN PATENT DOCUMENTS

| | | |
|---|---|---|
| 59-101562 | 6/1984 | Japan . |
| 4-369471 | 12/1992 | Japan . |
| 5-180059 | 7/1993 | Japan . |
| 6-200802 | 7/1994 | Japan . |
| 7-83094 | 3/1995 | Japan . |

*Primary Examiner*—Kevin J. Teska
*Assistant Examiner*—Jacques Louis-Jacques
*Attorney, Agent, or Firm*—Nikaido, Marmelstein, Murray & Oram LLP

[57] ABSTRACT

A system for estimating air/fuel ratios in the individual cylinders of a multicylinder internal combustion engine from the output of a single air/fuel ratio sensor installed at the exhaust system of the engine. A mathematical model is first designed to describe the behavior of the exhaust system which accepts the output of the air/fuel ratio sensor. An observer is designed to observe the internal state of the mathematical model and calculates the output which estimates the air/fuel ratios in the individual cylinders of the engine. In this configuration, when engine speed becomes high, the observer matrix calculation is discontinued, because it is difficult to ensure a time enough for calculation. Similarly, at a low engine load etc., the calculation is discontinued. Apart from the above, when a desired air/fuel ratio changes frequently such as when air/fuel ratio perturbation control is conducted, the desired air/fuel ratio is input to the observer as a second input. This will similarly be applied in a situation where the desired air/fuel ratio changes abruptly.

40 Claims, 16 Drawing Sheets

AIR/FUEL RATIO ESTIMATION SYSTEM FOR INTERNAL COMBUSTION ENGINE

BACKGROUND OF THE INVENTION

1. Field of the Invention

This invention relates to a system for estimating air/fuel ratio of an internal combustion engine, more particularly to a system for estimating air/fuel ratios in the individual cylinders of a multicylinder internal combustion engine with high accuracy.

2. Description of the Prior Art

It is a common practice to install an air/fuel ratio sensor at the exhaust system confluence point of a multicylinder internal combustion engine to detect the air/fuel ratio at that location. A system of this type is taught by Japanese Laid-Open Patent Application No. Sho 59(1984)-101,562, for example. Aside from the above, the assignee earlier proposed, in Japanese Laid-open Patent Application No. Hei 5-180,059 which was filed in the United States under the number of 07/997,769 now abandoned, designing a mathematical model describing the behavior of the exhaust system of a multicylinder internal combustion engine which can estimate air/fuel ratios in individual cylinders from the output of a single air/fuel ratio sensor disposed at the exhaust system confluence point through an observer. The sensor used there is not an $O_2$ sensor which produces an inverted output only in the vicinity of the stoichiometric air/fuel ratio, but a wide-range air/fuel ratio sensor which produces an output proportional to the oxygen concentration of oxygen in the exhaust gas.

With that arrangement, it became possible to estimate the air/fuel ratios in the individual cylinders with high accuracy. Depending on the operating condition of the engine, however, it may arise a situation where it would be difficult to ensure the calculation time or where the air/fuel ratio sensor response would be inadequate.

SUMMARY OF THE INVENTION

An object of the invention therefore is to provide a system for estimating air/fuel ratios in the individual cylinders of a multicylinder internal combustion engine which can cope with the above situations.

Furthermore, the aforesaid problem of calculation time becomes more serious when the air/fuel ratios in the individual cylinders are feedback controlled to a desired value(s) using estimated air/fuel ratios by the observer.

Another object of the invention therefore is to provide a system for estimating air/fuel ratios in the individual cylinders of a multicylinder internal combustion engine through the observer computation while feedback controlling the air/fuel ratios in the individual cylinders to a desired value which can cope with an engine operating condition in which it would be difficult to ensure the observer calculation time.

Furthermore, recent years have seen air/fuel ratio control in which the desired air/fuel ratio to be applied to the engine is intentionally perturbed or oscillated between lean and rich directions in order to utilize the catalytic converter's oxygen storage effect by perturbation, thereby enhancing the purification efficiency of the catalytic converter. The assignee earlier proposed this kind of control in Japanese Laid-open Patent Application No. Hei 6(1994)-200,802 which is now the U.S. Pat. No. 5,363,648.

With the air/fuel ratio perturbation control, the desired air/fuel ratio is adjusted frequently. In addition, the desired air/fuel ratio will change abruptly when the fuel supply is cut out or shifting from ordinary control to lean-burn control.

Yet another object of the invention therefore is to provide a system for estimating air/fuel ratios in the individual cylinders of a multicylinder internal combustion engine which still ensures estimation accuracy when the desired air/fuel ratio is changed frequently or abruptly.

For realizing these objects, the present invention provides a system for estimating air/fuel ratios in individual cylinders of a multicylinder internal combustion engine from an output of an air/fuel ratio sensor installed at an exhaust system of the engine, including a mathematical model describing behavior of the exhaust system which inputs the output of the air/fuel ratio sensor, and an observer observing an internal state of the mathematical model and calculating an output which estimates the air/fuel ratios in the individual cylinders of the engine. In the system the improvement comprises engine operating condition detecting means for detecting operating condition of the engine, discriminating means for discriminating if the detected engine operating condition is in a predetermined region and observer calculation discontinuing means for discontinuing the observer calculation when the detected engine operating condition is discriminated to be in the predetermined region.

BRIEF DESCRIPTION OF THE DRAWINGS

These and other objects and advantages of the invention will become more apparent from the following description and drawings, in which.

DETAILED DESCRIPTION OF THE PREFERRED EMBODIMENTS

Figure 1:
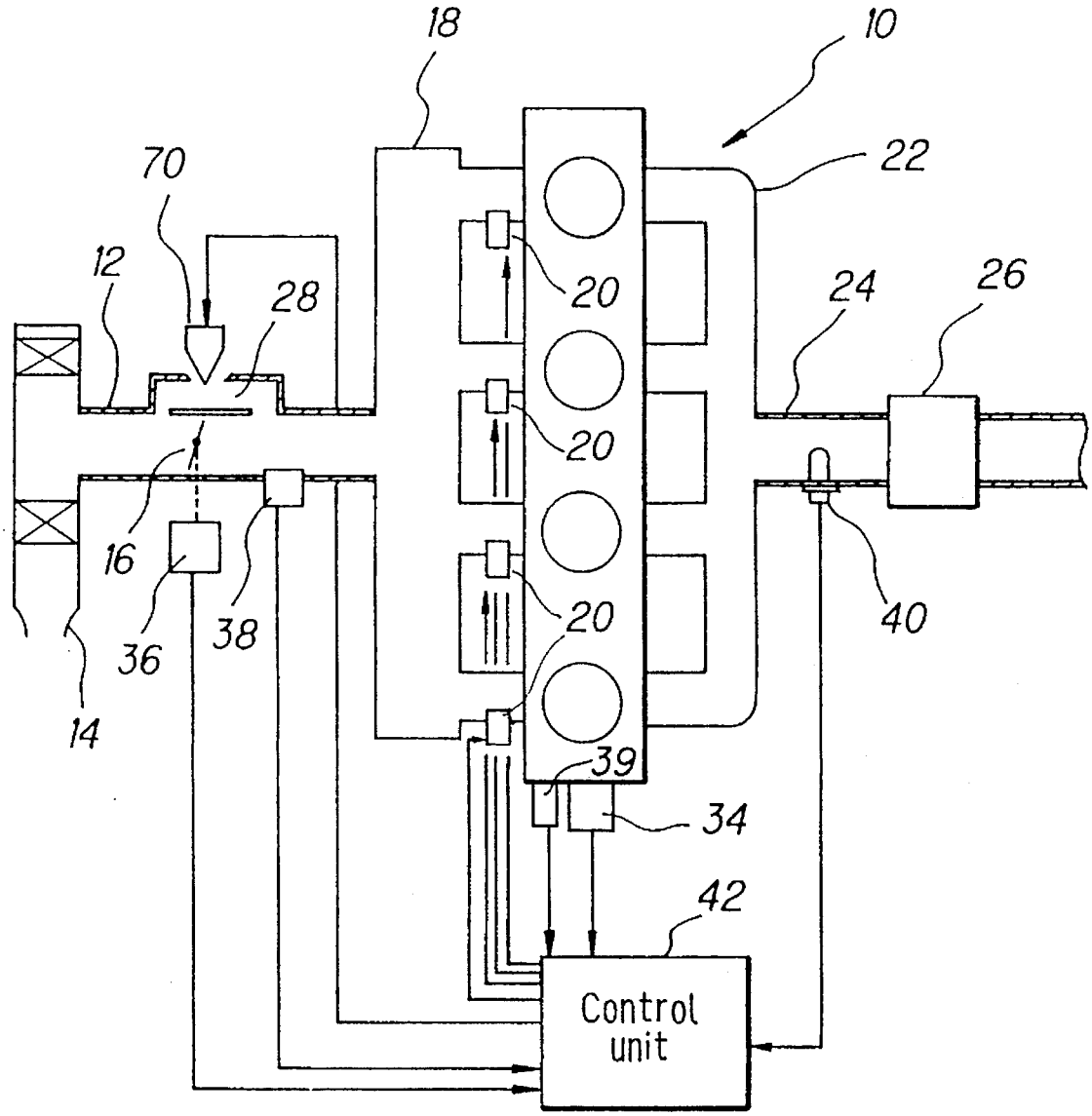
FIG. 1 is an overall schematic view of the air/fuel ratio estimation system for an internal combustion engine according to the invention.

FIG. 1 is an overall schematic view of an air/fuel ratio estimation system for an internal combustion engine according to this invention.

Reference numeral 10 in this figure designates a four-cylinder internal combustion engine. Air drawn in through an air cleaner 14 mounted on the far end of an air intake passage 12 is supplied to the first to fourth cylinders through an intake manifold 18 while the flow thereof is adjusted by a throttle valve 16. A fuel injector 20 for injecting fuel is installed in the vicinity of an intake valve (not shown) of each cylinder. The injected fuel mixes with the intake air to form an air-fuel mixture that is ignited in the associated cylinder by a spark plug (not shown). The resulting combustion of the air-fuel mixture drives down a piston (not shown). The exhaust gas produced by the combustion is discharged through an exhaust valve (not shown) into an exhaust manifold 22, from where it passes through an exhaust pipe 24 to a three-way catalytic converter 26 where it is removed of noxious components before being discharged to the exterior. In addition, the air intake path 12 is bypassed by a bypass 28 provided therein in the vicinity of the throttle valve 16.

A crank angle sensor 34 for detecting the piston crank angles is provided in an ignition distributor (not shown) of the internal combustion engine 10, a throttle position sensor 36 is provided for detecting the degree of opening of the throttle valve 16, and a manifold absolute pressure sensor 38 is provided for detecting the pressure of the intake air downstream of the throttle valve 16 as an absolute pressure. Additionally, a coolant water temperature sensor 39 is provided in a cylinder block (not shown) for detecting the temperature of a coolant water jacket (not shown) in the block. Also a wide-range air/fuel ratio sensor 40 constituted as an oxygen concentration detector is provided at the confluence point in the exhaust system between the exhaust manifold 22 and the three-way catalytic converter 26, where it detects the oxygen concentration of the exhaust gas at the confluence point and produces an output proportional thereto. The outputs of the crank angle sensor 34 and other sensors are sent to a control unit 42.

Figure 2:
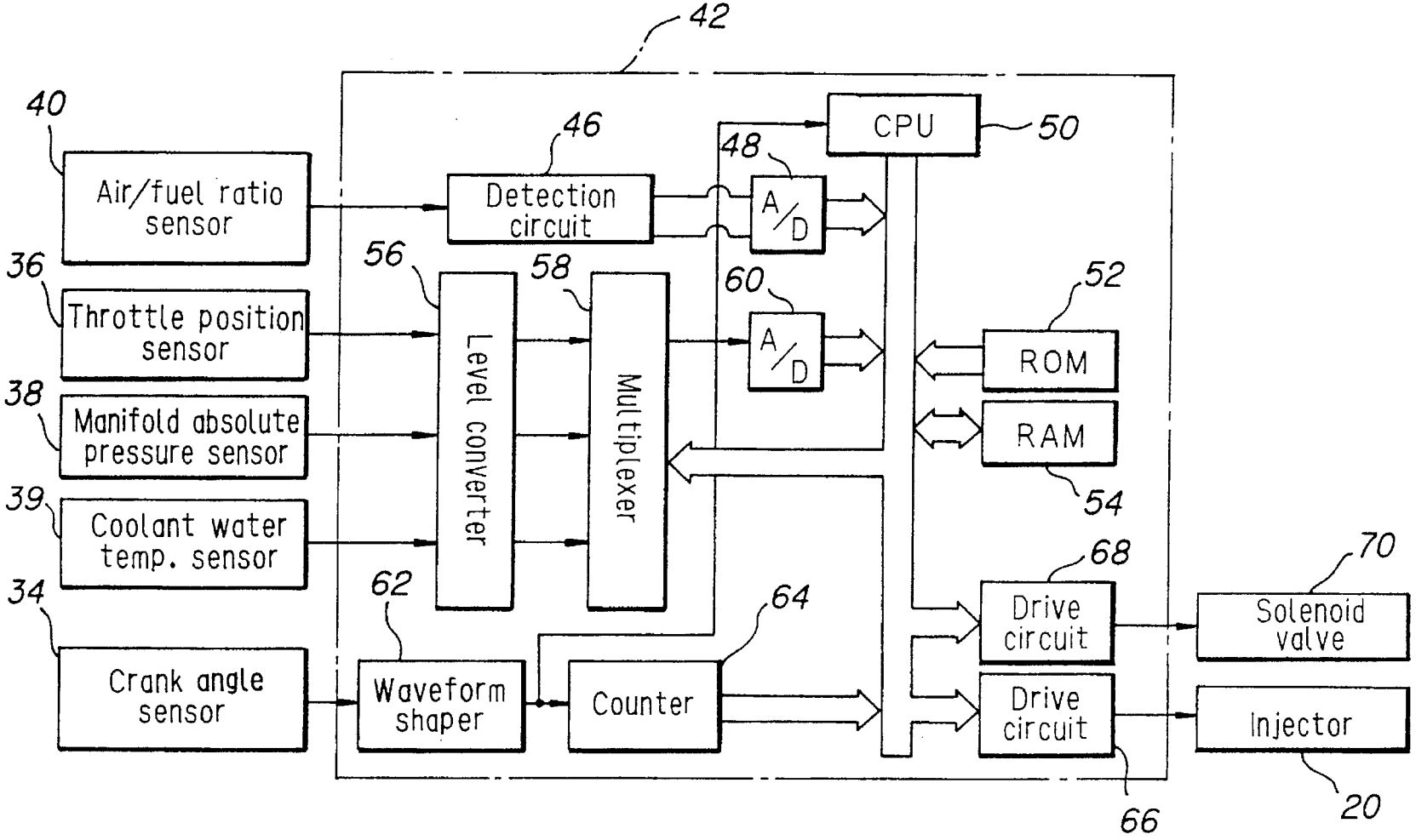
FIG. 2 is a block diagram showing the details of a control unit illustrated in FIG. 1.

Details of the control unit 42 are shown in the block diagram of FIG. 2. The output of the wide-range air/fuel ratio sensor 40 is received by a detection circuit 46 in the control unit 42, where it is subjected to appropriate linearization processing to obtain an air/fuel ratio (A/F) which varies linearly with the oxygen concentration of the exhaust gas over a broad range extending from the lean side to the rich side. As this air/fuel ratio sensor is explained in detail in the assignee's Japanese Laid-open Patent Application No. Hei 4-369,471 which was is now U.S. Pat. No. 5,391,282, it will not be explained further here. Hereinafter in this explanation, the air/fuel ratio sensor will be referred to as "LAF" sensor (linear A/F sensor). The output of the detection circuit 46 is forwarded through an A/D (analog/digital) converter 48 to a microcomputer comprising a CPU (central processing unit) 50, a ROM (read-only memory) 52 and a RAM (random access memory) 54 and is stored in the RAM 54.

Similarly, the analogue outputs of the throttle position sensor 36 etc. are input to the microcomputer through a level converter 56, a multiplexer 58 and a second A/D converter 60, while the output of the crank angle sensor 34 is shaped by a waveform shaper 62 and has its output value counted by a counter 64, the result of which is input to the microcomputer. In accordance with commands stored in the ROM 52, the CPU 50 of the microcomputer uses the detected values to compute a manipulated variable, drives the fuel injectors 20 of the respective cylinders via a drive circuit 66 for controlling fuel injection and drives a solenoid valve 70 via a second drive circuit 68 for controlling the amount of secondary air passing through the bypass 28 shown in FIG. 1. The CPU 50 also estimates the air/fuel ratios in the individual cylinders in a manner explained later so as to feedback control them to the desired air/fuel ratio.

Figure 3:
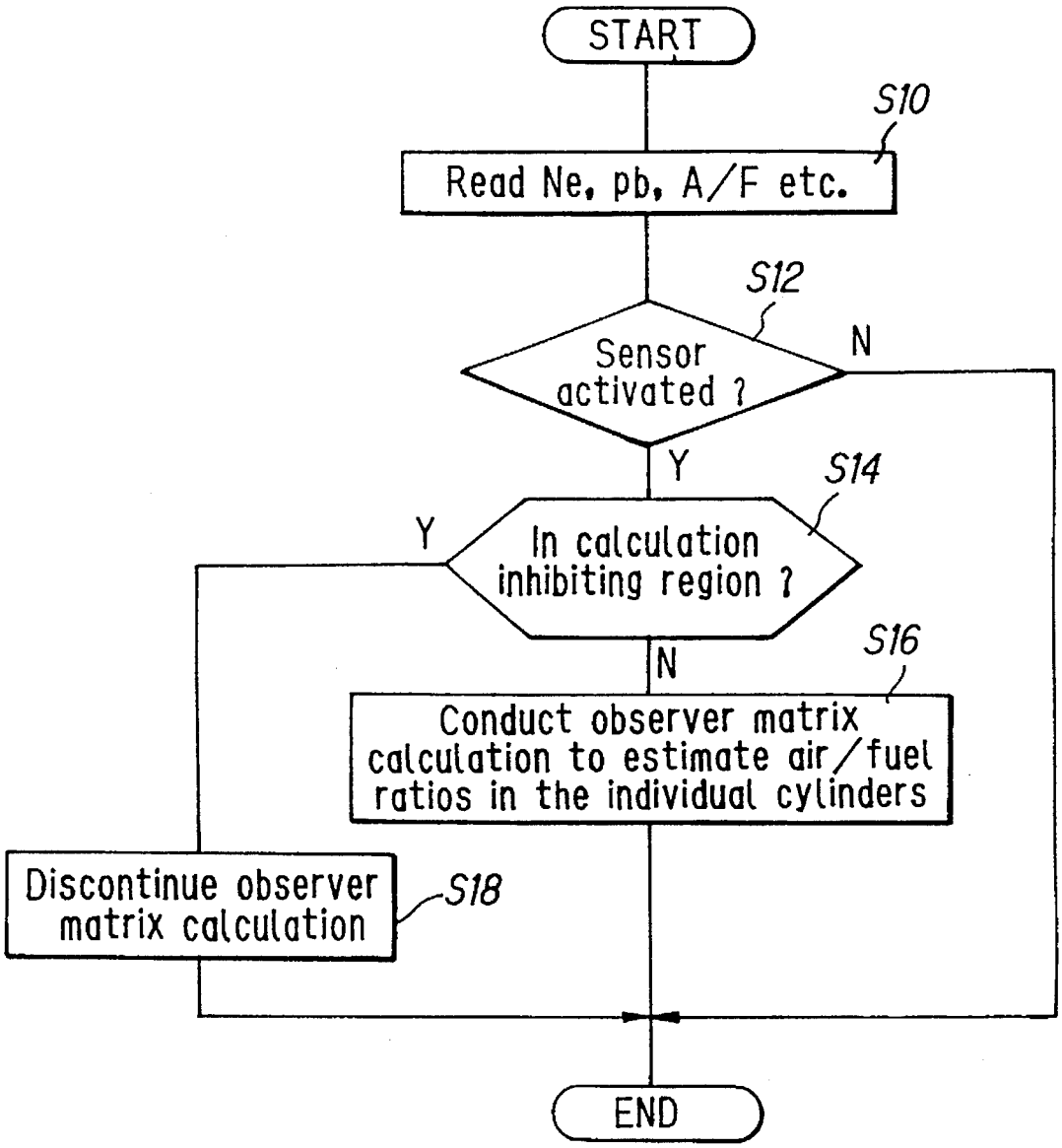
FIG. 3 is a flowchart which shows the operation of the air/fuel ratio estimation system illustrated in FIG. 1.

The operation of the system is shown by the flowchart of FIG. 3. For facilitating an understanding of the invention, however, an earlier proposed model which describes the behavior of an exhaust system will be explained first.

Figure 4:
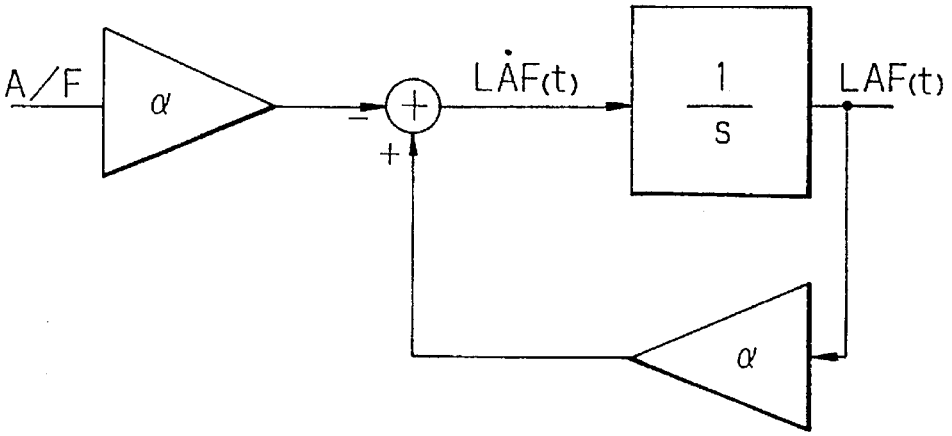
FIG. 4 is a block diagram showing a model which describes the behavior of detection of the air/fuel ratio referred to in the assignee's earlier application.

For high-accuracy separation and extraction of the air/fuel ratios in the individual cylinders from the output of a single LAF sensor it is necessary to first accurately ascertain the detection response delay (lag time) of the LAF sensor. The inventors therefore simulated this delay using a first-order lag time system as a model. For this they designed the model shown in FIG. 4. Here, if we define LAF: LAF sensor output and A/F: input air/fuel ratio, the state equation can be written as $$\dot{LAF}(t)=\alpha LAF(t)-\alpha A/F(t) \tag{1}$$

When this is discretized for period delta T, we get $$LAF(k+1)=\hat{\alpha}LAF(k)+(1-\hat{\alpha})A/F(k) \tag{2}$$

Here, $\hat{\alpha}$ is the correction coefficient and is defined as:

$$\hat{\alpha}=1+\alpha\Delta T+(1/2!)\alpha^2\Delta T^2+(1/3!)\alpha^3\Delta T^3+(1/4!)\alpha^4\Delta T^4$$

Figure 5:
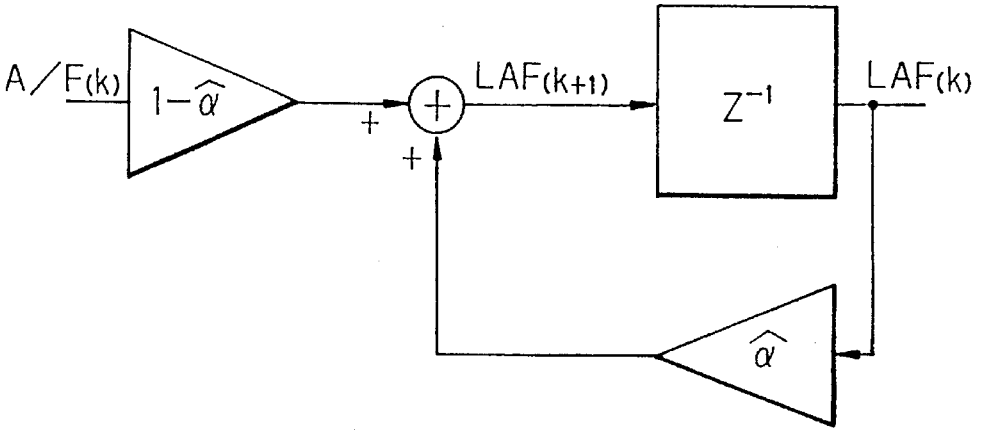
FIG. 5 is a block diagram which shows the model of FIG. 4 discretized in the discrete-time series for period delta T.

Equation 2 is represented as a block diagram in FIG. 5.

Therefore, Equation 2 can be used to obtain the actual air/fuel ratio from the sensor output. That is to say, since Equation 2 can be rewritten as Equation 3, the value at time k−1 can be calculated back from the value at time k as shown by Equation 4.

$$A/F(k)=\{LAF(k+1)-\hat{\alpha}LAF(k)\}/(1-\hat{\alpha}) \tag{3}$$

$$A/F(k-1)=\{LAF(k)-\hat{\alpha}LAF(k-1)\}/(1-\hat{\alpha}) \tag{4}$$

Figure 6:
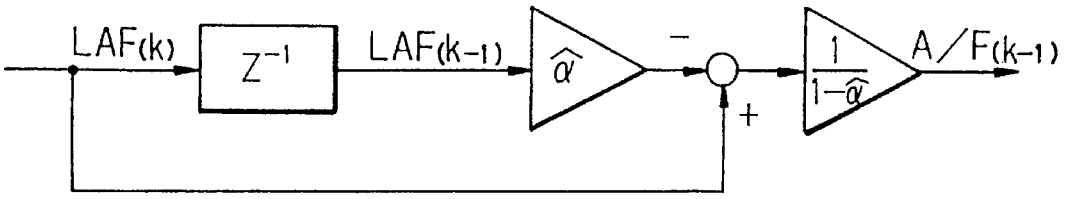
FIG. 6 is a block diagram showing a real-time air/fuel ratio estimator based on the model of FIG. 5.

Specifically, use of the Z transformation to express Equation 2 as a transfer function gives Equation 5, and a real-time estimate of the air/fuel ratio input in the preceding cycle can be obtained by multiplying the sensor output LAF of the current cycle by the inverse transfer function and the correction coefficient $\hat{\alpha}$. FIG. 6 is a block diagram of the real-time air/fuel ratio estimator.

$$t(z)=(1-\hat{\alpha})/(Z-\hat{\alpha}) \tag{5}$$

The method for separating and extracting the air/fuel ratios in the individual cylinders based on the actual air/fuel ratio obtained in the foregoing manner will now be explained. If the air/fuel ratio at the confluence point of the exhaust system is assumed to be an average weighted to reflect the time-based contribution of the air/fuel ratios in the individual cylinders, it becomes possible to express the air/fuel ratio at the confluence point at time k in the manner of Equation 6. (As F (fuel) was selected as the manipulated variable, the fuel/air ratio F/A is used here. For easier understanding, however, the air/fuel ratio will sometimes be used in the explanation. The term "air/fuel ratio" (or "fuel/air ratio") used herein is the actual value corrected for the response lag time calculated according to Equation 5.)

$$[F/A](k)=C_1[F/A\#_1]+C_2[F/A\#_3]+C_3[F/A\#_4]+C_4[F/A\#_2]$$

$$[F/A](k+1)=C_1[F/A\#_3]+C_2[F/A\#_4]+C_3[F/A\#_2]+C_4[F/A\#_1]$$

$$[F/A](k+2)=C_1[F/A\#_4]+C_2[F/A\#_2]+C_3[F/A\#_1]+C_4[F/A\#_3] \tag{6}$$

Figure 7:
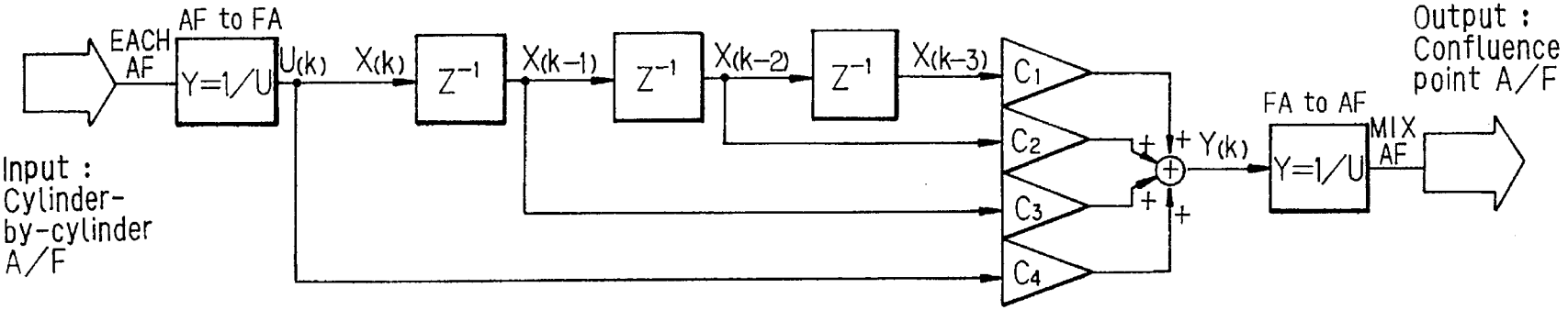
FIG. 7 is a block diagram showing a model which describes the behavior of the exhaust system of the engine referred to in the assignee's earlier application.

More specifically, the air/fuel ratio at the confluence point can be expressed as the sum of the products of the past firing histories of the respective cylinders and weights C (for example, 40% for the cylinder that fired most recently, 30% for the one before that, and so on). This model can be represented as a block diagram as shown in FIG. 7.

Its state equation can be written as $$\begin{pmatrix} x(k-2) \\ x(k-1) \\ x(k) \end{pmatrix} = \begin{pmatrix} 010 \\ 001 \\ 000 \end{pmatrix} \begin{pmatrix} x(k-3) \\ x(k-2) \\ x(k-1) \end{pmatrix} + \begin{pmatrix} 0 \\ 0 \\ 1 \end{pmatrix} u(k) \tag{7}$$

Further, if the air/fuel ratio at the confluence point is defined as y(k), the output equation can be written as $$y(k) = [c_1\ c_2\ c_3] \begin{pmatrix} x(k-3) \\ x(k-2) \\ x(k-1) \end{pmatrix} + c_4 u(k) \tag{8}$$

Here:

$c_1$:0.25379, $c_2$:0.10121, $c_3$:0.46111, $c_4$:0.18389

Since u(k) in this equation cannot be observed, even if an observer is designed from the equation, it will still not be possible to observe x(k). Thus, if one defines x(k+1)=x(k−3) on the assumption of a stable operating state in which there is no abrupt change in the air-fuel ratio from that 4 TDCs earlier (i.e., from that of the same cylinder), Equation 9 is obtained.

$$\begin{pmatrix} x(k-2) \\ x(k-1) \\ x(k) \\ x(k+1) \end{pmatrix} = \begin{pmatrix} 0100 \\ 0010 \\ 0001 \\ 1000 \end{pmatrix} \begin{pmatrix} x(k-3) \\ x(k-2) \\ x(k-1) \\ x(k) \end{pmatrix}$$

$$y(k) = [c_1\ c_2\ c_3\ c_4] \begin{pmatrix} x(k-3) \\ x(k-2) \\ x(k-1) \\ x(k) \end{pmatrix} \tag{9}$$

Figure 8:
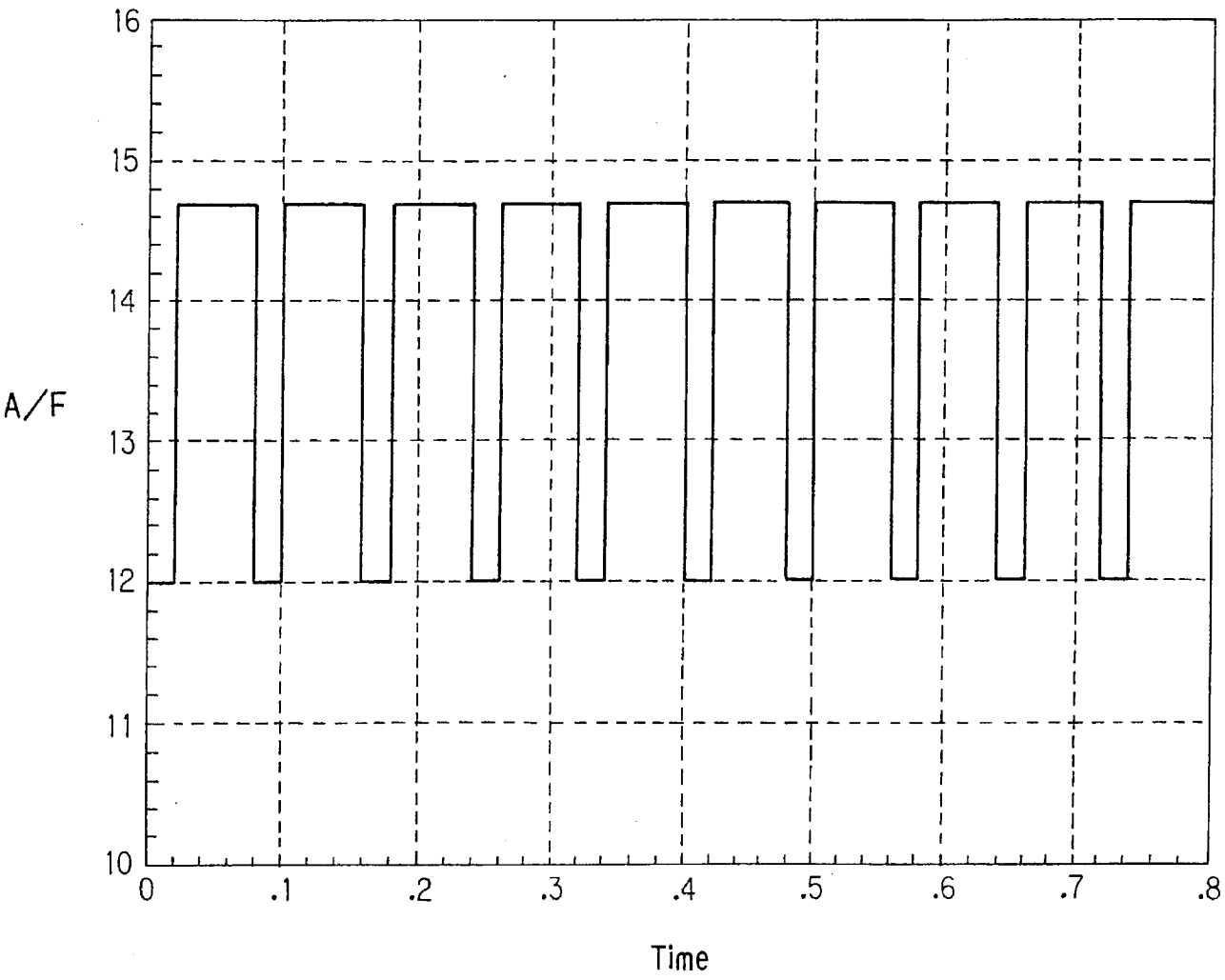
FIG. 8 is a graph of simulation where fuel is assumed to be supplied to three cylinders of a four-cylinder engine so as to obtain an air/fuel ratio of 14.7:1 and to one cylinder so as to obtain an air/fuel ratio of 12.0:1.
Figure 9:
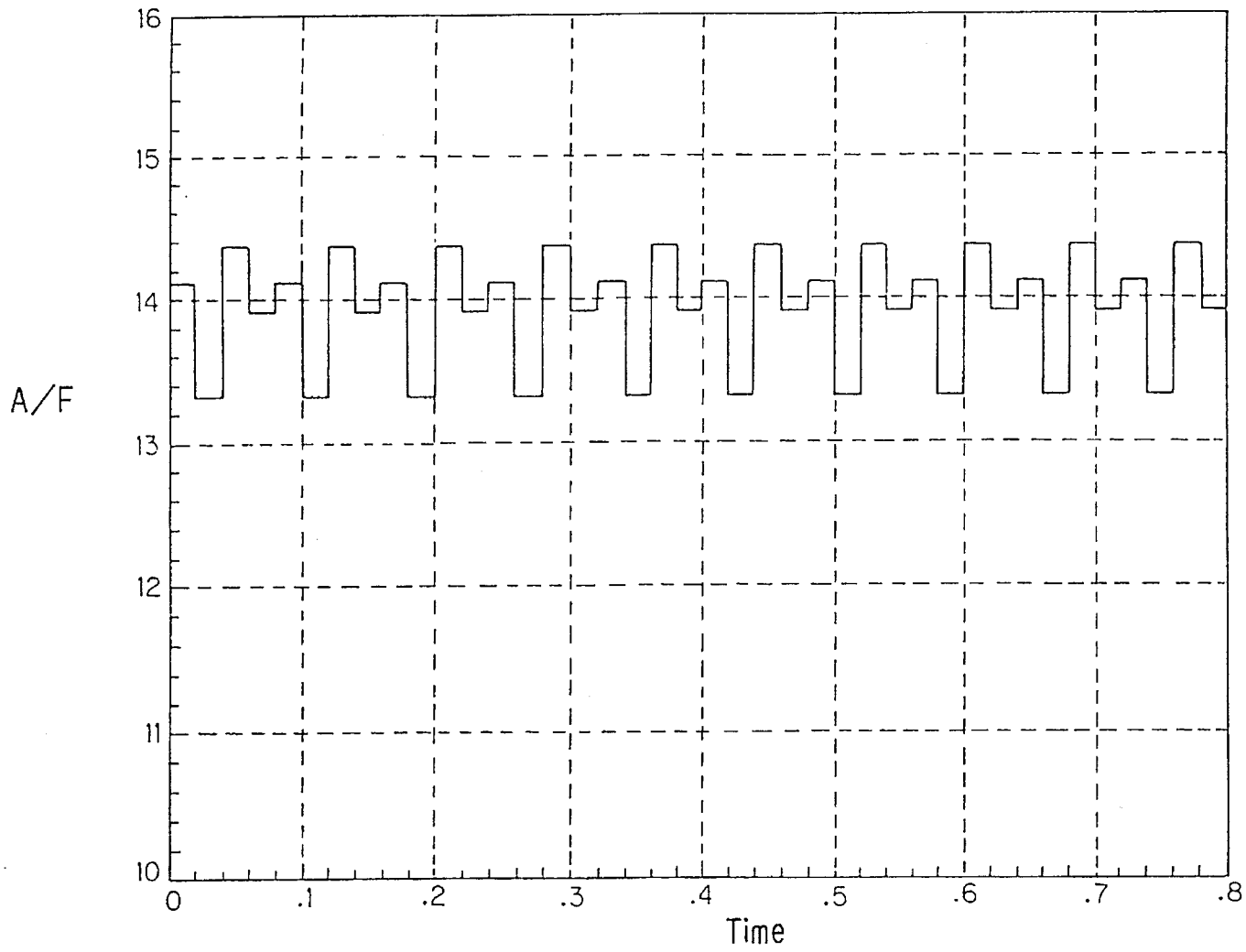
FIG. 9 is the result of the simulation which shows the output of the exhaust system model and the air/fuel ratio at a confluence point when the fuel is supplied in the manner illustrated in FIG. 8.
Figure 10:
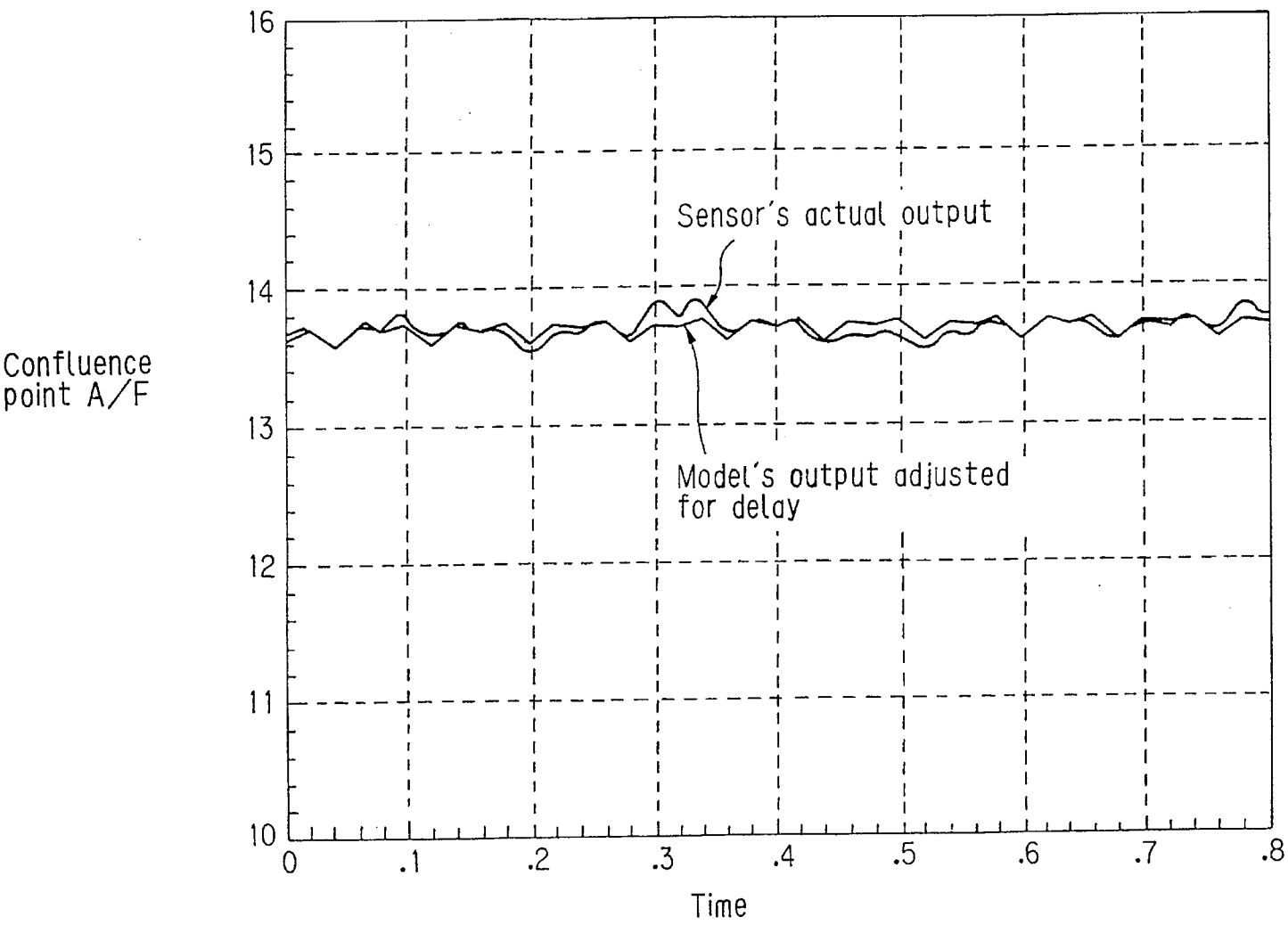
FIG. 10 is the result of the simulation which shows the output of the exhaust system model adjusted for sensor detection response delay (time lag) in contrast with the sensor's actual output.

The simulation results for the model obtained in the foregoing manner will now be given. FIG. 8 relates to the case where fuel is supplied to three cylinders of a four-cylinder internal combustion engine so as to obtain an air/fuel ratio of 14.7:1 and to one cylinder so as to obtain an air/fuel ratio of 12.0:1. FIG. 9 shows the air/fuel ratio at this time at the confluence point as obtained using the aforesaid model. While FIG. 9 shows that a stepped output is obtained, when the response delay (lag time) of the LAF sensor is taken into account, the sensor output becomes the smoothed wave designated "Model's output adjusted for delay" in FIG. 10. The curve marked "Sensor's actual output" is based on the actually observed output of the LAF sensor under the same conditions. The close agreement of the model results with this verifies the validity of the model as a model of the exhaust system of a multiple cylinder internal combustion engine.

Thus, the problem comes down to one of an ordinary Kalman filter in which x(k) is observed in the state equation, Equation 10, and the output equation. When the weighted matrices Q, R are determined as in Equation 11 and the Riccati's equation is solved, the gain matrix K becomes as shown in Equation 12.

$$\begin{cases} X(k+1) &= AX(k)+Bu(k) \\ y(k) &= CX(k)+Du(k) \end{cases} \tag{10}$$

Here:

$$A = \begin{pmatrix} 0100 \\ 0010 \\ 0001 \\ 1000 \end{pmatrix} \quad C=[c_1c_2c_3c_4] \quad B=D=[0]$$

$$X(k) = \begin{pmatrix} x(k-3) \\ x(k-2) \\ x(k-1) \\ x(k) \end{pmatrix}$$

$$Q = \begin{pmatrix} 1000 \\ 0100 \\ 0010 \\ 0001 \end{pmatrix} \quad R=[1] \tag{11}$$

$$K = \begin{pmatrix} -0.3093 \\ 1.1918 \\ 0.3093 \\ 0.0803 \end{pmatrix} \tag{12}$$

Obtaining A-KC from this gives Equation 13.

$$A-KC = \begin{pmatrix} 0.0785 & 1.0313 & 0.1426 & 0.0569 \\ -0.3025 & -0.1206 & 0.4505 & -0.2192 \\ -0.0785 & -0.0313 & -0.1426 & 0.9431 \\ 0.9796 & -0.0081 & -0.0370 & -0.0148 \end{pmatrix} \tag{13}$$

Figure 11:
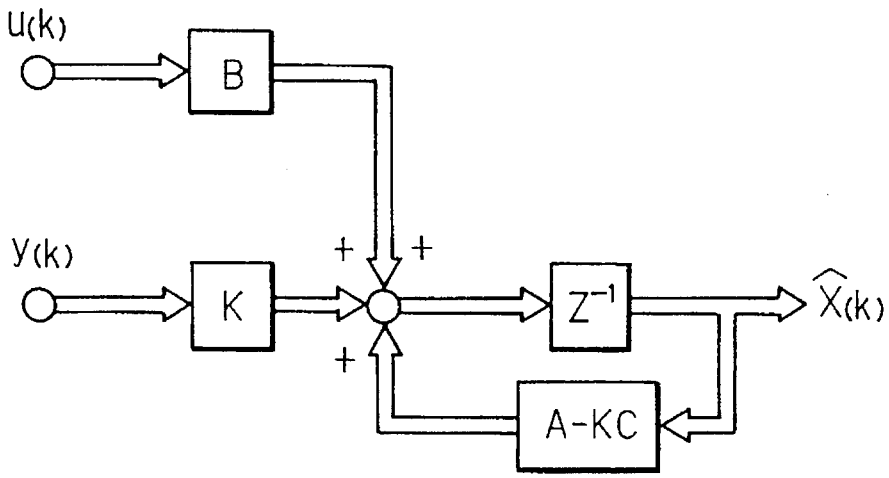
FIG. 11 is a block diagram which shows the configuration of an ordinary observer.
Figure 12:
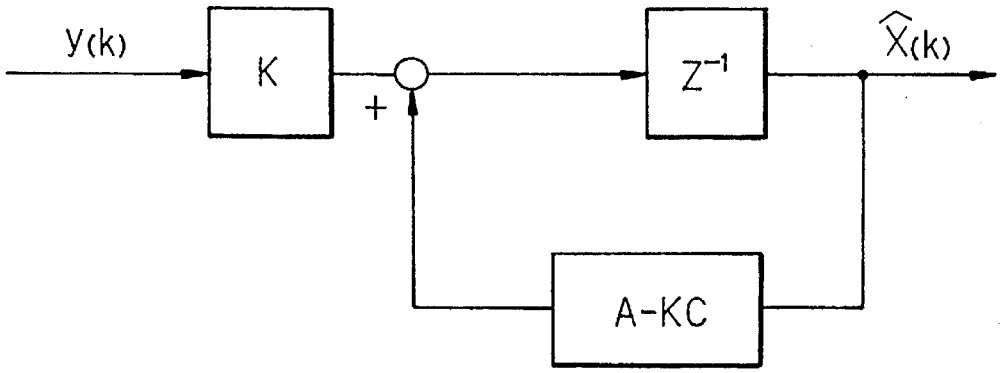
FIG. 12 is a block diagram which shows the configuration of the observer referred to in the assignee's earlier application.

FIG. 11 shows the configuration of an ordinary observer. Since there is no input u(k) in the present model, however, the configuration has only y(k) as an input, as shown in FIG. 12. This is expressed mathematically by Equation 14.

$$\begin{cases} \hat{X}(k+1) &= [A-KC]\hat{X}(k)+Ky(k) \\ \hat{x}(k) &= [0001]\hat{X}(k) \end{cases} \tag{14}$$

The system matrix of the observer whose input is y(k), namely of the Kalman filter, is $$S = \left( \begin{array}{c|c} A-KC & K \\ \hline 0001 & 0 \end{array} \right) \tag{15}$$

In the present model, when the ratio of the member of the weighted matrix R in Riccati's equation to the member of Q is 1:1, the system matrix S of the Kalman filter is given as $$S=\begin{pmatrix} 0.0785 & 1.0313 & 0.1426 & 0.0569 & -0.3093 \\ -0.3025 & -0.1206 & 0.4505 & -0.2192 & 1.1918 \\ -0.0785 & -0.0313 & -0.1426 & 0.9431 & 0.3093 \\ 0.9796 & -0.0081 & -0.0370 & -0.0148 & 0.0803 \\ 0.0 & 0.0 & 0.0 & 1.0 & 0.0 \end{pmatrix} \quad (16)$$

Figure 13:
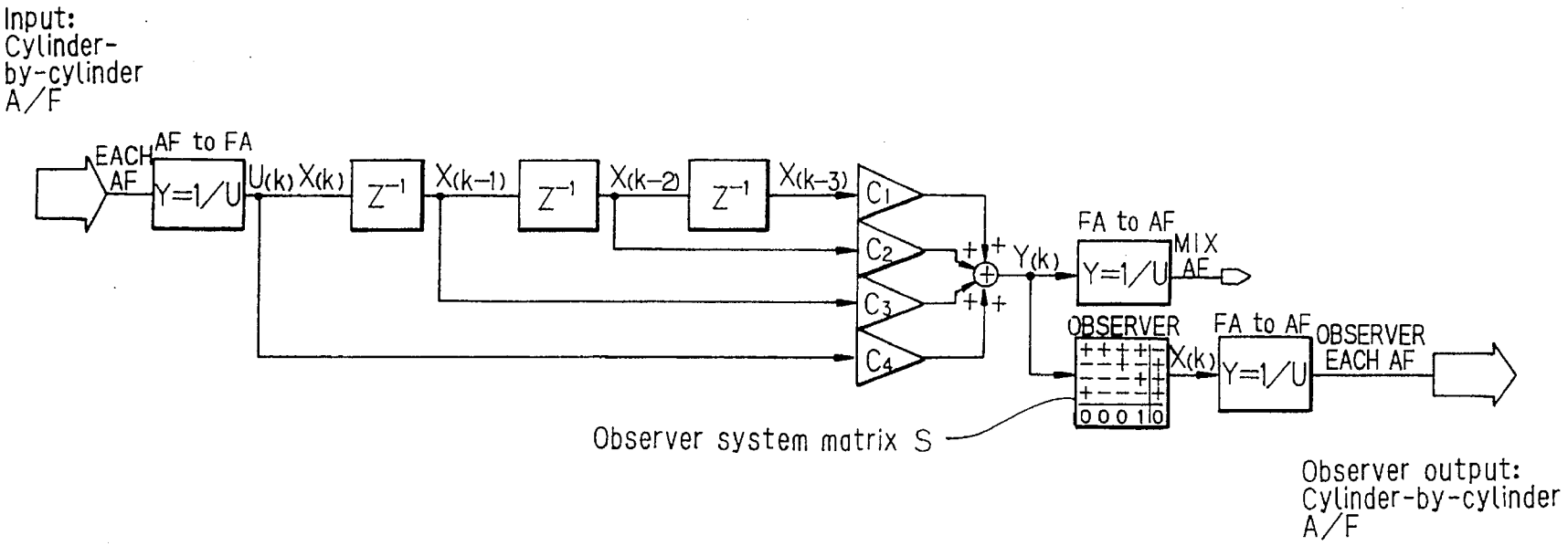
FIG. 13 is an explanatory block diagram which shows the configuration resulting from the combination of the model of FIG. 7 and the observer of FIG. 12.

FIG. 13 shows the configuration in which the aforesaid model and observer are combined. As this was described in detail in the assignee's earlier application, no further explanation will be given here. With the arrangement, it becomes possible to accurately estimate the individual cylinders' air/fuel ratios from the confluence point air/fuel ratio.

Based on the foregoing, the operation of the system according to the invention will now be explained.

The program begins at step S10 in which the outputs of the aforesaid sensors are read and the program proceeds to step S12 in which it is discriminated in an appropriate manner whether the LAF sensor 40 has been activated and if it does, to step S14 in which it is discriminated whether the engine operating condition is at a region in which the observer matrix calculation is inhibited.

An example of such a region would be a high engine speed region. Namely, as mentioned earlier, since the TDC intervals become shorter as engine speed increases, it becomes difficult to ensure the observer calculation time satisfactorily at high engine speed. In addition, the response of the LAF sensor 40 is inadequate at such a high engine speed due to the detection delay explained with reference to Equation 1. Other examples of the region in which the calculation inhibited would be when the engine running with a low load or when the supply of fuel has been cut off. That is; when the engine operation is at a low load, it takes much time for the exhaust gas to reach the LAF sensor 40 than that at a high engine load. And when the supply of fuel has been cut off, no exhaust gas will flow.

Therefore, a marginal high engine speed at which it is difficult to ensure the calculation time or the sensor response is inadequate is determined in advance and is compared with the detected engine speed Ne in step S14 in the flowchart of FIG. 3. Similarly, a marginal low engine load is determined in advance in terms of the manifold absolute pressure Pb and is compared with the detected manifold absolute pressure Pb. In step S14, thus, when the detected engine speed Ne does not exceed the marginal high engine speed and when the detected manifold absolute pressure Pb is not less than the marginal low manifold absolute pressure and when the fuel supply has been cut off, the program proceeds to step S16 in which the observer matrix calculation is conducted to estimate the air/fuel ratio for the cylinder concerned. On the other hand, when the detected engine speed Ne exceeds the marginal high engine speed, or when the detected manifold absolute pressure Pb is less than the marginal low manifold absolute pressure, or when the fuel supply has been cut off, it is deemed that the engine operation is at the region in which the observer matrix calculation is inhibited and the program therefore proceeds to step S18 in which the observer matrix calculation is discontinued. Incidentally, when the LAF sensor is discriminated to be inactive, the program is immediately terminated.

This is because, in fuel metering control, when it is impossible to ensure the calculation time of a fuel injection quantity at a high engine speed, the quantity calculated before is often used. The calculation is thus thinned out at a high speed. The configuration according to the invention, however, is based on the assumption that the confluence point air/fuel ratio is the sum of the products of the past firing histories of the respective cylinders and the state equation describing this is expressed as a recurrence formula. Additionally, on the assumption of a stable engine operation state in which there is no abrupt change in the air/fuel ratio from that 4 TDCs earlier, i.e. from that of the same cylinder, the observer is designed and the observer matrix is calculated successively following the firing order of the engine in accordance with Equation 9.

Thus, the observer calculation is conducted following the firing order by inputting the preceding cylinder's air/fuel ratio successively. Accordingly, if one among the successive calculation for a certain cylinder is thinned out, the relationship between the calculation result and the cylinder concerned will be lost. As a result, the cylinder's air/fuel ratio estimation would be erroneous.

In the embodiment, in view of the above, the observer matrix calculation is discontinued at the calculation inhibiting region. In other words, the observer matrix calculation is not thinned out, but is ceased completely at the calculation inhibiting region, there is no possibility that the calculation result for one cylinder is not assigned to the other cylinder, which would otherwise occur if the calculation is thinned out.

Figure 14:
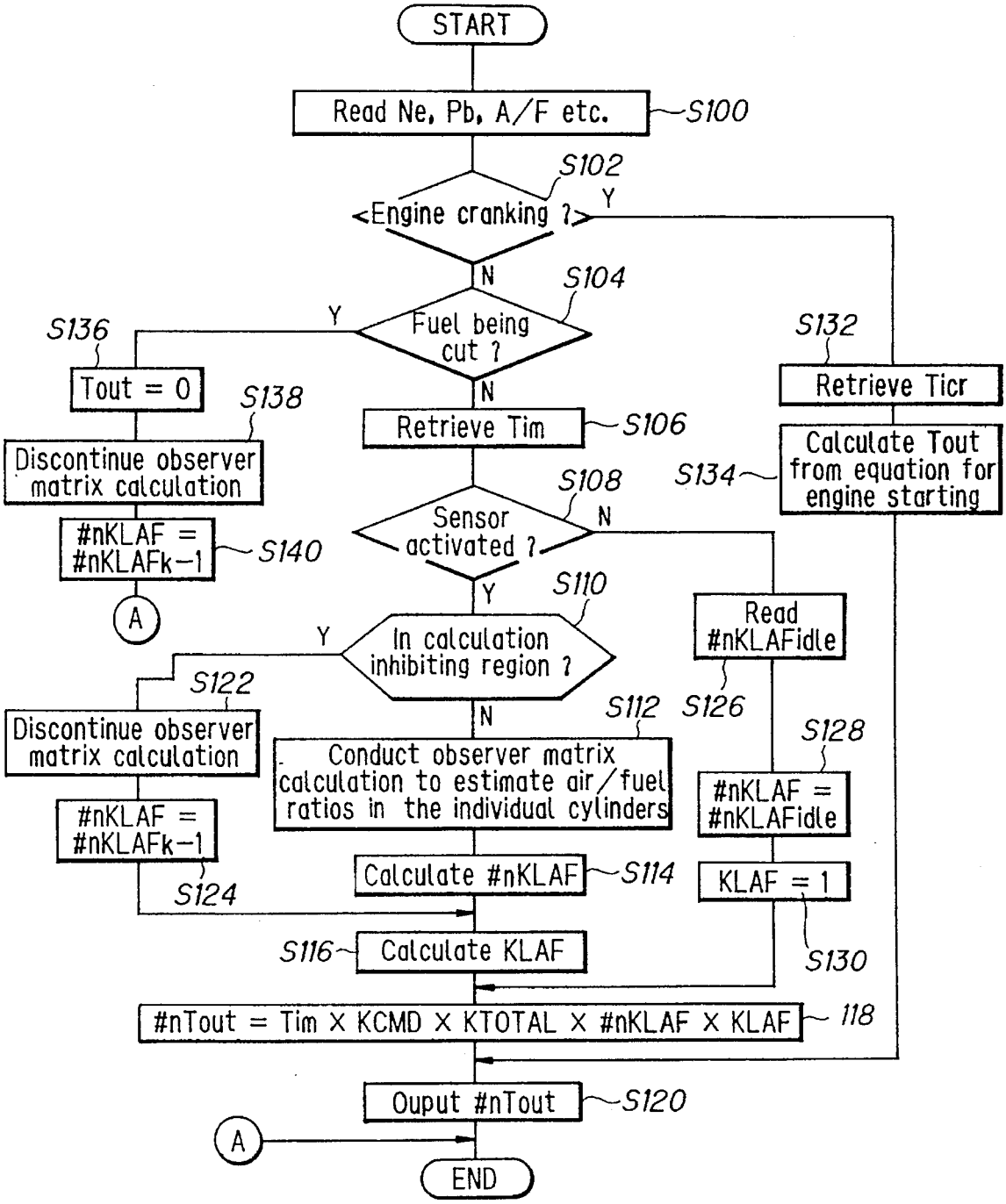
FIG. 14 is a flowchart, similar to FIG. 3, but showing a second embodiment of the invention.

FIG. 14 is a flowchart, similar to FIG. 3, but showing a second embodiment of the invention.

In the second embodiment, the air/fuel ratios in the individual cylinders are feedback controlled to a desired air/fuel ratio based on the estimated air/fuel ratio.

Figure 15:
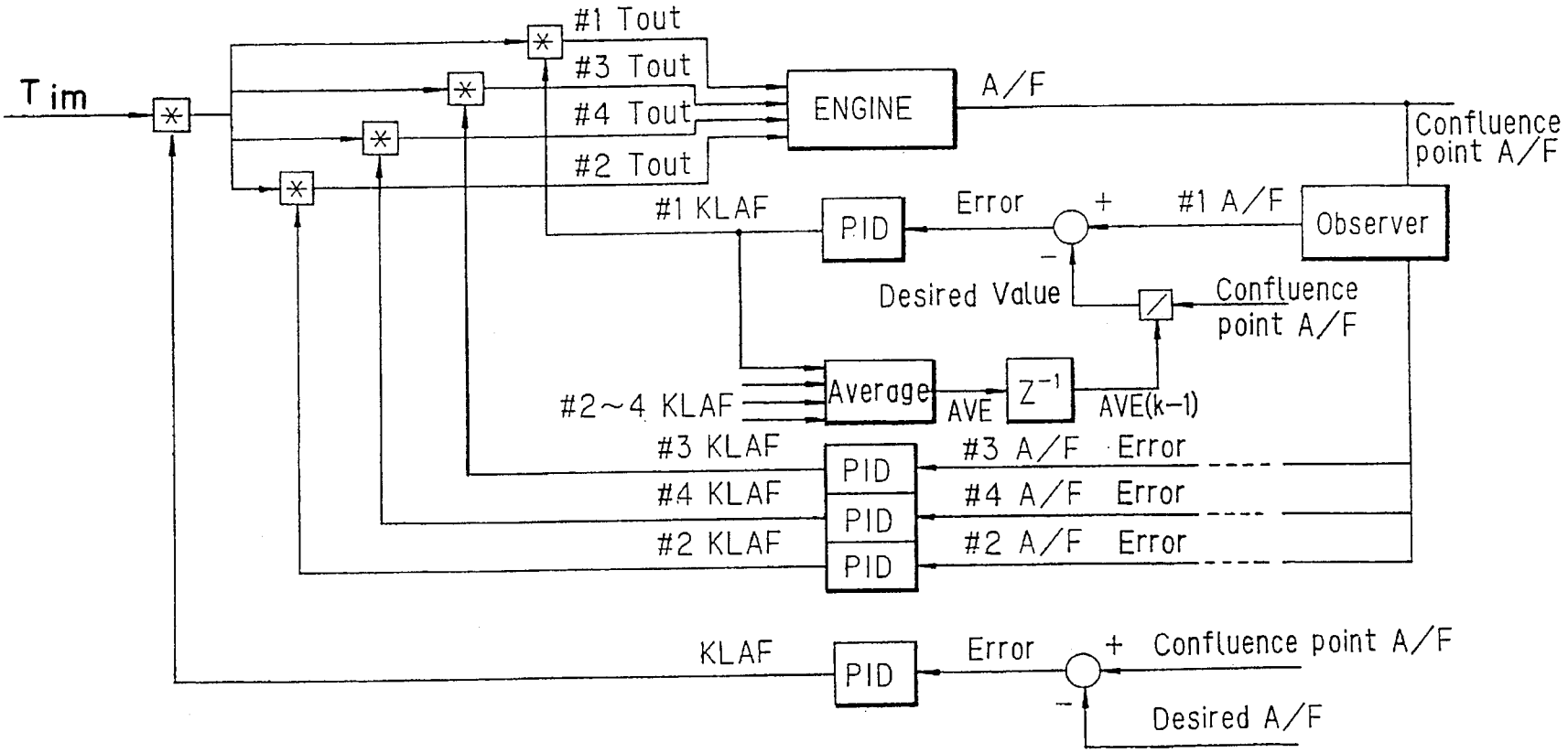
FIG. 15 is a block diagram which shows the overall configuration of the air/fuel ratio feedback control based on the air/fuel ratio estimation according to the invention.

Namely, since the observer is able to estimate the cylinder-by-cylinder air/fuel ratio (each cylinder's air/fuel ratio) from the air/fuel ratio at the confluence point, the air/fuel ratios at the individual cylinders can be separately controlled by a PID controller or the like. Specifically, as shown in FIG. 15, a confluence point air/fuel ratio feedback factor (gain) KLAF is calculated from the LAF sensor output (exhaust confluence point air/fuel ratio) and the desired air/fuel ratio using a PID controller, while a cylinder-by-cylinder air/fuel ratio feedback control factors (gains) #nKLAF (n: cylinder) for the individual cylinders are calculated on the basis of the air/fuel ratios #nA/F estimated by the observer. The cylinder-by-cylinder air/fuel ratio feedback factors are calculated, more precisely, to decrease an error between the desired value obtained by the exhaust confluence point air/fuel ratio by the average AVEk−1 in the preceding cycle of the average AVE of the feedback factors #nKLAF of all cylinders and the air/fuel ratios #nA/F estimated by the observer.

With this arrangement, the air/fuel ratios in the individual cylinders converge to the confluence point air/fuel ratio and the confluence point air/fuel ratio converges, in turn, to the desired air/fuel ratio. Thus, the air/fuel ratios of all cylinders can therefore be converged to the desired air/fuel ratio. The fuel injection quantity #nTout (n: cylinder) for each cylinder here can be calculated in the term of the opening period of the fuel injector 20 as $$\#nTout = Tim \times KCMD \times KTOTAL \times \#nKLAF \times KLAF$$

where Tim: base value, KCMD: desired air/fuel ratio (expressed as equivalence ratio to be multiplied by the base value), KTOTAL: other correction factors. While an addition factor for battery correction and other addition factors might also be involved, they are omitted here. As this control is described in detail in the assignee's earlier Japanese Patent Application No. Hei 5(1993)-251,138, it will not be described further here.

With this arrangement, the cylinder-by-cylinder air/fuel ratio feedback loop operates to converge the cylinder-by-cylinder air/fuel ratios to the confluence point air/fuel ratio through the feedback factors #nKLAF and, moreover, since the average value AVE of the feedback factors #nKLAF tends to converge to 1.0, the factors do not diverge and the variance between cylinders is absorbed as a result. On the other hand, since the confluence point air/fuel ratio converges to the desired air/fuel ratio, the air/fuel ratios of all cylinders can therefore be converged to the desired air/fuel ratio.

This is because when the feedback factors #nKLAF are all set to 1.0 in the configuration of the cylinder-by-cylinder air/fuel ratio feedback loop shown in FIG. 15, the operation continues until the feedback loop error disappears, i.e. until the denominator (the average value of the feedback factors #nKLAF) becomes 1.0, indicating that the variance in air/fuel ratio between cylinders has been eliminated.

Based on the foregoing, the second embodiment will now be explained with reference to the flowchart of FIG. 14. The program determines the fuel injection quantity #nTout (n: cylinder) for each cylinder in the firing order of #1, #3, #4 and #2 at every predetermined crank angles after the TDC (Top Dead Center) crank angular position.

The program begins at step S100 in which the detected engine speed Ne and the like are read and advances to step S102 in which it is checked whether the engine is cranking and if it is not, to step S104 in which it is discriminated whether the fuel supply to the engine has been cut off. If the result at step S104 is negative, the program proceeds to step S106 in which the aforesaid base value Tim is retrieved from mapped data, whose characteristics are not shown, using the engine speed Ne and manifold absolute pressure Pb as address data, to step S108 in which it is discriminated whether the LAF sensor has been activated in an appropriate manner and if it has, to step S110 in which it is discriminated whether the engine operating condition is at the aforesaid region in which the observer matrix calculation is inhibited.

If the result at the step S110 is negative, the program proceeds to step S112 in which the observer matrix calculation is performed to estimate the air/fuel #nA/F for the cylinder concerned, to step S114 in which the cylinder-by-cylinder air/fuel ratio feedback factor #nKLAF for the cylinder concerned is determined. Namely, as mentioned earlier, the feedback factor for the cylinder concerned is determined such that the error between 1) the desired value obtained by the exhaust confluence point air/fuel ratio by the average AVEk−1 in the preceding cycle of the average AVE of the feedback factors #nKLAF of all the cylinders and 2) air/fuel ratio #nA/F for the cylinder concerned estimated by the observer decreases.

The program then proceeds to step S116 in which the other feedback factor KLAF for confluence point air/fuel ratio control is determined such that the error between the exhaust confluence point air/fuel ratio detected by the LAF sensor 40 and the desired air/fuel ratio decreases. The program then proceeds to step S118 in which the fuel injection quantity #nTout for the cylinder concerned is determined as illustrated, to step S120 in which the determined value #nTout is output to drive the fuel injector 20 for the cylinder concerned.

On the other hand, if the step S110 finds that the engine operating condition is in the calculation inhibiting region, the program moves to step S122 in which the observer matrix calculation is completely discontinued, to step S124 in which the cylinder-by-cylinder air/fuel ratio feedback factor #nKLAF for the cylinder concerned is left as it is, i.e., the value #nKLAFk−1 determined in the preceding program cycle for the cylinder concerned is again used in the current program cycle. (For purpose of the brevity in illustration, attaching suffix "k" to the current value has been omitted.)

Specifically, the observer matrix calculation is not thinned out, but is ceased completely at the calculation inhibiting region, during which the fuel injection quantity is determined using the factor determined in the preceding cycle. This is because, the extent of change of the variance between the individual cylinders' air/fuel ratios is intrinsically small so that the feedback factors #nKLAF are relatively smaller than the feedback factor KLAF. The feedback factors #nKLAF are usually about 1.0. Moreover, in view of the observation performed by the on-board microcomputer, the calculation inhibiting region itself is unavoidable. By using the preceding values of the feedback factors #nKLAF which are less inclined to change than the feedback factor KLAF at such a region, it does, however, become possible to make the air/fuel ratio fluctuation to lessen.

From the flowchart, if it has been discriminated in step S108 that the LAF sensor is inactive, the program goes to step S126 in which a value #nKLAFidle for the cylinder concerned and calculated while the engine was idling is read from backup memory in the RAM 54, to step S128 in which the read value is deemed as that for the current cycle, to step S130 in which the confluence point air/fuel ratio feedback factor KLAF is set to 1.0 (this means that the confluence point air/fuel ratio feedback control is discontinued), to step S118 in which the fuel injection quantity #nTout for the cylinder concerned is calculated as illustrated using these values.

Specifically, when step S108 finds that the LAF sensor is inactive, the engine is being started following the cranking (S102). In that case, by using the value calculated at idling before the engine was stopped, the air/fuel ratio variance among the cylinders can be kept as small as possible. The reason why the value calculated at engine idling is used is that, since the engine speed is low at idling, a relatively long computation time is ensured, which enhances the observer estimation accuracy.

On the other hand, if it is found in step S102 that the engine is cranking, the program moves to step S132 in which a basic fuel injection quantity Ticr at cranking is determined in accordance with predetermined characteristics using the detected coolant water temperature, to step S134 in which a fuel injection quantity Tout is determined in accordance with an equation for engine startup. When step S104 finds that the fuel supply has been cut off, the program goes to step S136 in which a fuel injection quantity is made zero, to step S138 in which observer matrix calculation is discontinued, to step S140 in which the feedback factor #nKLAFk−1 is again used. The reason why the observer matrix calculation is discontinued at S138 is that, since no combustion occurs, no exhaust gas flows as mentioned earlier, therefore it is impossible to detect the air/fuel ratio correctly.

With this arrangement, similar to the first embodiment, since the observer matrix calculation is not thinned out, but is ceased completely at the calculation inhibiting region, there is no possibility that the calculation result for one cylinder is not assigned to the other cylinder, which would otherwise occur if the calculation is thinned out.

Moreover, since it is considered that the variance in the fuel supply system among the cylinders is relatively small for the period during which the observer calculation is discontinued so that the value obtained just before the calculation is stopped, the air/fuel variance among the cylinders can be absorbed to a fair extent and the air/fuel ratio in the individual cylinders can be converged to the desired air/fuel ratio with accuracy, enhancing the purification efficiency of the catalytic converter 26. In such a case, if the desired air/fuel ratio is set to be lean, the lean-burn control will be carried out effectively.

Figure 16:
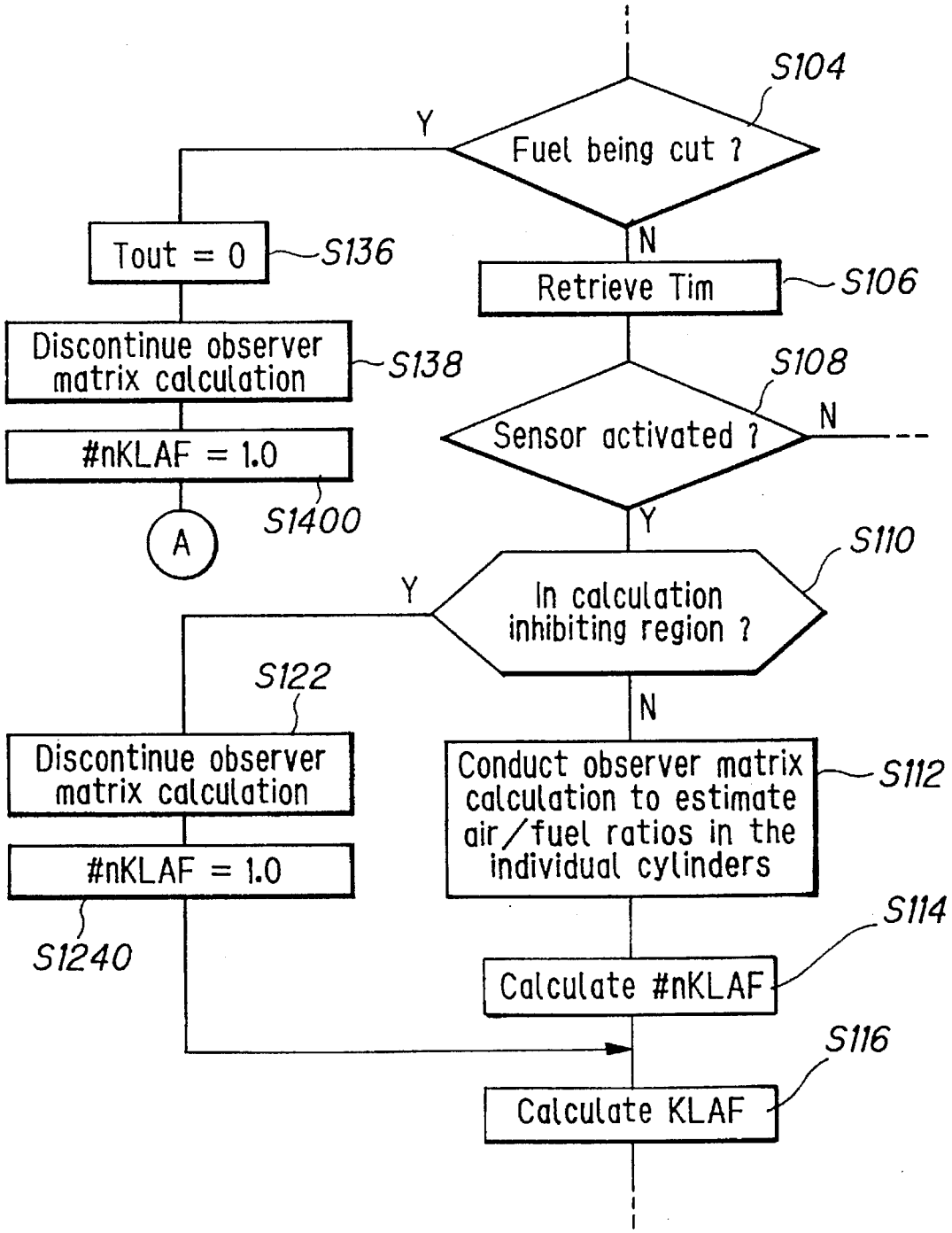
FIG. 16 is a portion of a flowchart, similar to FIG. 14, but showing a third embodiment of the invention.

FIG. 16 is a portion of a flowchart, partly similar to FIG. 14, but showing a third embodiment of the invention.

Focussing on its difference from the second embodiment, when it is determined in step S122 that the observer matrix calculation is stopped, the program proceeds to step S1240 in which the feedback factor #nKLAF for the cylinder concerned is set to 1.0. This is because, the air/fuel variance among cylinders is relatively small so that the factor is about 1.0 as mentioned earlier, the factor is fixed as 1.0 when the calculation is discontinued. With this arrangement, the configuration of the third embodiment is simpler than that of the second embodiment. The remaining steps are the same as those of the second embodiment.

Figure 17:
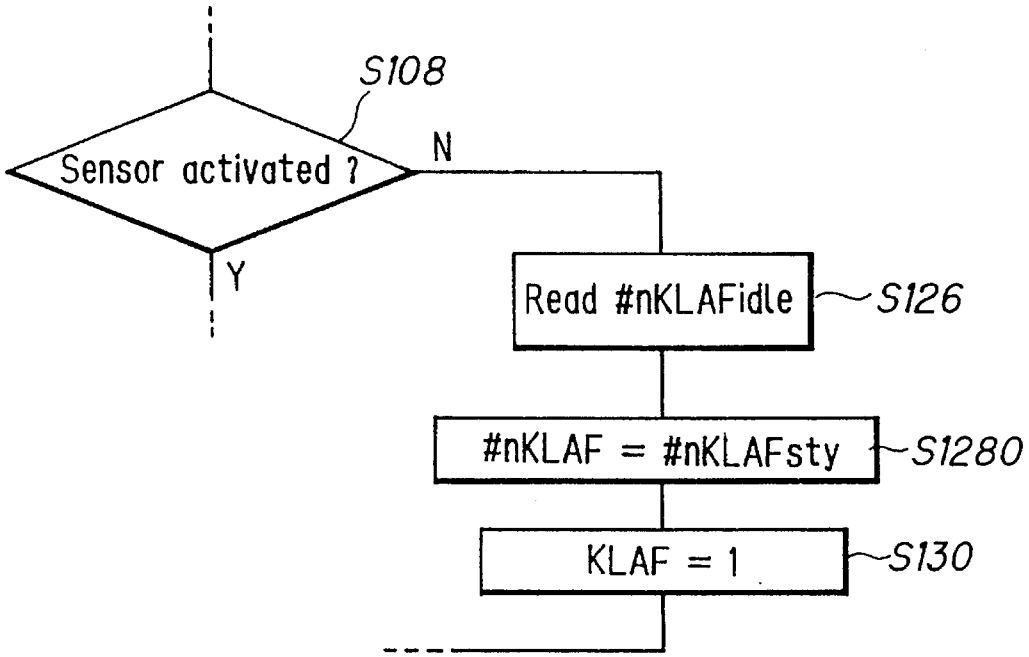
FIG. 17 is a portion of a flowchart, similar to FIG. 14, but showing a fourth embodiment of the invention.

FIG. 17 is a portion of a flowchart, partly similar to FIG. 14, but showing a fourth embodiment of the invention.

Focussing again on its difference from the second embodiment, when the LAF sensor is found to be inactive at step S108 and then the value #nKLAFidle is read at step S126, the program proceeds to step S1280 in which a value #nKLAFsty obtained through learning is used as the feedback factor #nKLAF. More precisely, the feedback factor had been learned at engine idling before the engine was stopped using the following equation and the learned value is used when the LAF sensor is found to be inactive.

$$\#nKLAFsty = C \times \#nKLAF + (1-C) \times \#nKLAFstyk-1$$

Here, #nKAFsty: current learned value, C: weight, #nKLAFstyk−1: value learned in the previous cycle. With this arrangement, it is possible to further reflect the past firing histories in the feedback factor. The rest of the steps are the same as those of the second embodiment.

Figure 18:
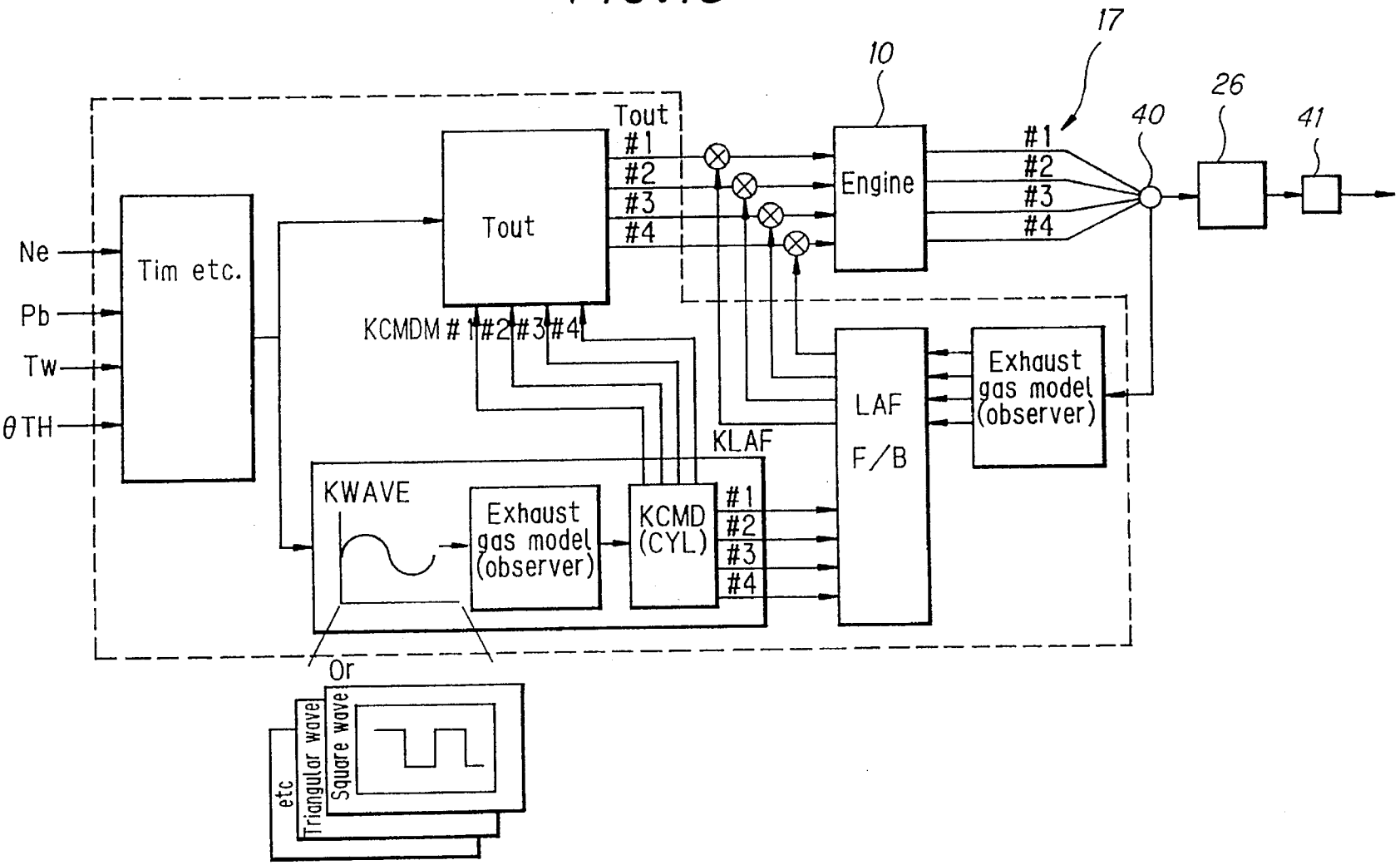
FIG. 18 is a block diagram which shows the air/fuel ratio perturbation control to be used in the explanation of a fifth embodiment of the invention.

FIG. 18 is an explanation view showing the air/fuel ratio perturbation control to be used in the explanation of a fifth embodiment of the invention.

The fifth embodiment relates to the case in which the desired air/fuel ratio is frequently or abruptly changed. The most pertinent example of such a case is the air/fuel ratio perturbation control. For facilitating an understanding of the invention, the earlier proposed air/fuel ratio perturbation control is briefly explained with reference to FIG. 18.

Figure 19:
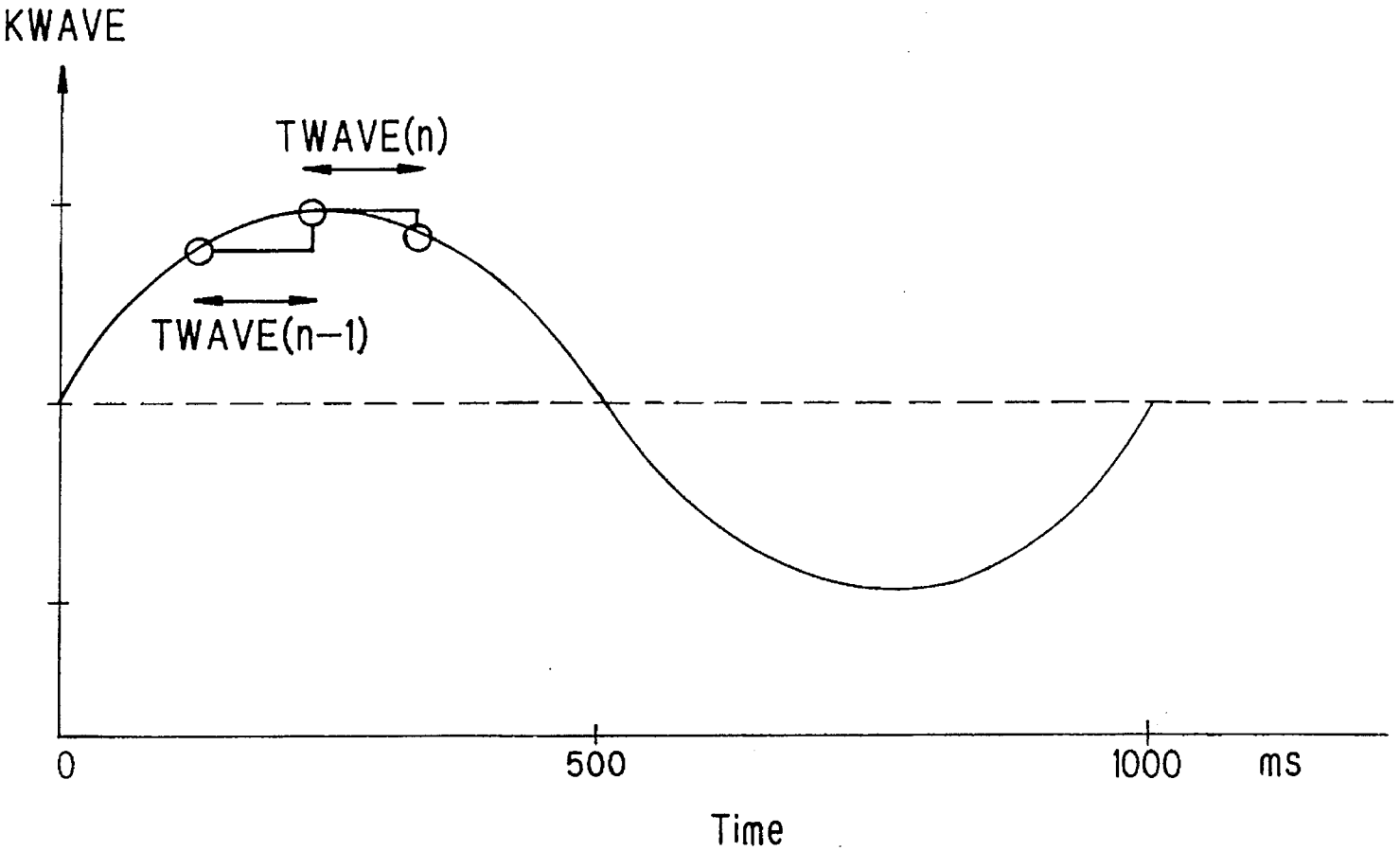
FIG. 19 is a graph which shows the perturbation or oscillation of the desired air/fuel ratio in the control illustrated in FIG. 18.

As mentioned earlier in the previous embodiments, the air/fuel ratios in the individual cylinders are estimated by the observer from the output of the LAF sensor 40 and are feedback controlled to the desired air/fuel ratio KCMD. An $O_2$ sensor 41 is installed downstream from the catalytic converter 26. The desired air/fuel ratio KCMD is multiplied by a correction factor KWAVE such that the value KCMD perturbs or osculates at a predetermined cycle and a predetermined amplitude. FIG. 19 shows a table which illustrates the characteristics of the factor KWAVE. Specifically, the factor KWAVE is retrieved by a sampling period TWAVE. Since, however, the details of the control were described in the earlier application, no further explanation will be given here.

As stated before, the configuration according to the invention, however, is based on the assumption that there is no abrupt change in the air/fuel ratio from that 4 TDCs earlier, i.e. from that of the same cylinder, the observer is built and the observer matrix is calculated successively following the firing order of the engine. In perturbation control, however, since the desired air/fuel ratio KCMD is varied frequently, this assumption does not apply.

In the fifth embodiment, therefore, as a second input, the desired air/fuel ratio for the cylinder concerned is used, since the desired air/fuel ratio KCMD is considered to be extremely close to the current exhaust air/fuel ratio of the cylinder. This is shown in Equation 17. When the observer is expressed as a state equation, it can be expressed as per Equation 18.

$$\begin{pmatrix} x(k-2) \\ x(k-1) \\ x(k) \\ x(k+1) \end{pmatrix} = \begin{pmatrix} 0100 \\ 0010 \\ 0001 \\ 1000 \end{pmatrix} \begin{pmatrix} x(k-3) \\ x(k-2) \\ x(k-1) \\ x(k) \end{pmatrix} + \begin{pmatrix} 0 \\ 0 \\ 0 \\ 1 \end{pmatrix} \text{Desired } x(k+1)$$

$$y(k) = [c_1\ c_2\ c_3\ c_4] \begin{pmatrix} x(k-3) \\ x(k-2) \\ x(k-1) \\ x(k) \end{pmatrix} \tag{17}$$

$$\begin{cases} \hat{X}(k+1) = [A - KC]\hat{X}(k) + Ky(k) + Bu(k) \\ \hat{x}(k) = [0001]\hat{X}(k) \end{cases} \tag{18}$$

More specifically, since the actual exhaust air/fuel ratio is controlled so as to be converged to the desired air/fuel ratio with the air/fuel ratio perturbation control, if the desired air/fuel ratio is input to the observer as a second input, it is the same as if the estimated air/fuel ratio were input. With this arrangement, therefore, it is possible to estimate the air/fuel ratios with high accuracy, even when the desired air/fuel ratio is frequently changed.

It should be noted here, however, that, although the desired air/fuel ratio is determined for the individual cylinders respectively in the perturbation control proposed earlier, the perturbation control referred to in the fifth embodiment is not limited as such and can also be applied to the control where the desired air/fuel ratio is determined for the four cylinders.

It should also be noted that, although the air/fuel ratio perturbation control is explained as an example of changing the desired air/fuel ratio frequently or abruptly, the fifth embodiment will also be applied to other situations such as a time when the fuel supply has been cut off or at a transient time to the lean-burn control.

It should still further be noted that, while the invention has been explained with respect to the embodiments using a wide-range air/fuel ratio sensor as the air/fuel ratio sensor, the invention can also be partly applied to the case in which the $O_2$ sensor is used.

The present invention has thus been shown and described with reference to specific embodiments. However, it should be noted that the present invention is in no way limited to the details of the described arrangements and that changes and modifications can be made without departing from the scope of the appended claims.

What is claimed is:

1. A system for controlling air/fuel ratios of individual cylinders of a multicylinder internal combustion engine connected to an exhaust pipe via an exhaust manifold constituting an exhaust system of the engine, comprising:

an air/fuel ratio sensor installed at said exhaust system of the engine;

a detection circuit for receiving an output of said air/fuel ratio sensor to determine an air/fuel ratio at a confluence point;

estimating means for estimating the air/fuel ratios of the individual cylinders of the engine based on an exhaust gas behavior describing means which describes behavior of the exhaust system at the confluence point;

fuel injection quantity determining means for determining a fuel injection quantity to be supplied to the engine based on at least one of a base fuel injection value and the estimated air/fuel ratios of the individual cylinders;

a fuel injector for injecting fuel based on the determined fuel injection quantity;

engine operating condition detecting means for detecting operating condition of the engine;

discriminating means for discriminating if the detected engine operating condition is in a predetermined region; and discontinuing means for causing said estimating means to discontinue the estimation of the air/fuel ratios when the detected engine operating condition is discriminated to be in the predetermined region whereby an air/fuel ratio, which may be erroneous, is not estimated in said predetermined region.

2. A system according to claim 1, wherein the predetermined region is a region in which an engine speed is higher than a marginal high speed.

3. A system according to claim 1, wherein the predetermined region is a region in which an engine load is lesser than a marginal low load.

4. A system according to claim 1, wherein the predetermined region is a region in which supply of fuel to the engine has been cut off.

5. A system according to claim 1, further including:

air/fuel ratio feedback control loop for correcting the fuel injection quantity using a feedback factor such that the air/fuel ratios of the individual cylinders converges to a desired air/fuel ratio;

and when said discontinuing means causes said estimating means to discontinue the estimation of the air/fuel ratios, the feedback factor is set to a prescribed value.

6. A system according to claim 5, wherein the prescribed value is the feedback factor determined before the estimating means was discontinued.

7. A system according to claim 5, wherein the prescribed value is 1.0.

8. A system according to claim 5, wherein the prescribed value is a value at a predetermined engine operating condition.

9. A system according to claim 8, wherein the value at a predetermined engine operating condition is the feedback factor calculated while the engine was idling when the air/fuel ratio sensor is inactive.

10. A system according to claim 8, wherein the value at a predetermined engine operating condition is the feedback factor learned when the engine was idling while the air/fuel ratio sensor is inactive.

11. A system according to claim 1, wherein said exhaust gas behavior describing means includes a mathematical model having a recurrence formula based upon the air/fuel ratio at the confluence point being expressed as a sum of products of past firing histories of the individual cylinders and a weighting coefficient, each indicative of contribution thereto of the individual cylinders, and an observer means which estimates the air/fuel ratios of the individual cylinders of the engine based on the mathematical model.

12. A system for controlling air/fuel ratios of individual cylinders of a multicylinder internal combustion engine connected to an exhaust pipe via an exhaust manifold constituting an exhaust system of the engine, comprising:

an air/fuel ratio sensor installed at said exhaust system of the engine;

a detection circuit for receiving an output of said air/fuel ratio sensor to determine an air/fuel ratio at a confluence point;

estimating means for estimating the air/fuel ratios of the individual cylinders of the engine based on the output of an exhaust gas behavior describing means which describes behavior of the exhaust system at the confluence point;

fuel injection quantity determining means for determining a fuel injection quantity to be supplied to the engine based on at least one of a base fuel injection value and the estimated air/fuel ratios of the individual cylinders;

air/fuel ratio feedback control loop for correcting the fuel injection quantity using a feedback factor such that the air/fuel ratios in the individual cylinders converge to at least one of a desired air/fuel ratio and a desired value; and a fuel injector for injecting fuel based on the determined fuel injection quantity;

wherein the desired air/fuel ratio is input to the estimating means as another input whereby highly accurate air/fuel ratios are estimated even when the desired air/fuel ratio changes frequently.

13. A system according to claim 12, wherein the desired air/fuel ratio is perturbed at a predetermined cycle and a predetermined amplitude.

14. A system according to claim 12, wherein said exhaust gas behavior describing means includes a mathematical model having a recurrence formula based upon the air/fuel ratio at the confluence point being expressed as a sum of products of past firing histories of the individual cylinders and a weighting coefficient, each indicative of contribution thereto of the individual cylinders, and an observer means which estimates the air/fuel ratios of the individual cylinders of the engine based on the mathematical model.

15. A system for controlling air/fuel ratios of individual cylinders of a multicylinder internal combustion engine connected to an exhaust pipe via an exhaust manifold constituting an exhaust system of the engine, comprising:

an air/fuel ratio sensor installed at a confluence point of the exhaust system of the engine;

a detection circuit for receiving an output of said air/fuel ratio sensor to determine an air/fuel ratio at the confluence point;

estimating means for estimating the air/fuel ratios in the individual cylinders from an output of an exhaust gas system behavior deriving means which derives behavior of the exhaust system;

fuel injection quantity determining means for determining a fuel injection quantity to be supplied to the engine based on at least one of a base fuel injection value and the estimated air/fuel, ratios of the individual cylinders;

a fuel injector for injecting fuel based on the determined fuel injection quantity;

engine operating condition detecting means for detecting operating condition of the engine; and discriminating means for discriminating whether the detected engine operating condition is in a predetermined region; and wherein said estimating means discontinuing to estimate the air/fuel ratios of the individual cylinders when the detected engine operating condition is discriminated to be in the predetermined region whereby a possibly erroneous air/fuel ratio is not estimated in said predetermined region.

16. A system according to claim 15, wherein the predetermined region is a region in which an engine speed is higher than a marginal high speed.

17. A system according to claim 15, wherein the predetermined region is a region in which an engine load is lesser than a marginal low load.

18. A system according to claim 15, wherein the predetermined region is a region in which supply of fuel to the engine has been cut off.

19. A system according to claim 15, further including:

air/fuel ratio feedback control loop for correcting the fuel injection quantity using a feedback factor such that the air/fuel ratios of the individual cylinders converges to a desired air/fuel ratio;

and when said estimating means discontinues to estimate the air/fuel ratios of the individual cylinders, the feedback factor is set to a prescribed value.

20. A system according to claim 19, wherein the prescribed value is the feedback factor determined before the estimating means was discontinued.

21. A system according to claim 19, wherein the prescribed value is 1.0.

22. A system according to claim 19, wherein the prescribed value is a value at a predetermined engine operating condition.

23. A system according to claim 22, wherein the value at a predetermined engine operating condition is the feed-back factor calculated while the engine was idling when the air/fuel ratio sensor is inactive.

24. A system according to claim 22, wherein the value at a predetermined engine operating condition is the feed-back factor calculated through learning while the engine was idling when the air/fuel ratio sensor is inactive.

25. A system according to claim 15, wherein said exhaust gas behavior deriving means includes a mathematical model having a recurrence formula based upon the air/fuel ratio at the confluence point being expressed as a sum of products of past firing histories of the individual cylinders and a weighting coefficient, each indicative of contribution thereto of the individual cylinders, and an observer means which estimates the air/fuel ratios of the individual cylinders of the engine based on the mathematical model.

26. A system for controlling air/fuel ratios of individual cylinders of a multicylinder internal combustion engine connected to an exhaust pipe via an exhaust manifold constituting an exhaust system of the engine, comprising:

an air/fuel ratio sensor installed at a confluence point of the exhaust system of the engine;

a detection circuit for receiving an output of said air/fuel ratio sensor to determine an air/fuel ratio at the confluence point;

estimating means for estimating the air/fuel ratios in the individual cylinders from an output of an exhaust gas system behavior deriving means which derives behavior of the exhaust system;

fuel injection quantity determining means for determining a fuel injection quantity to be supplied to the engine based on at least one of a base fuel injection value and the estimated air/fuel ratios of the individual cylinders; and a fuel injector for injecting fuel based on the determined fuel injection quantity;

wherein a desired air/fuel ratio is input to the estimating means as another input whereby highly accurate air/fuel ratios are estimated even when the desired air/fuel ratio changes frequently.

27. A system according to claim 26, wherein the desired air/fuel ratio is perturbed at a predetermined cycle and a predetermined amplitude.

28. A system according to claim 26, wherein said exhaust gas behavior deriving means includes a mathematical model having a recurrence formula based upon the air/fuel ratio at the confluence point being expressed as a sum of products of past firing histories of the individual cylinders and a weighting coefficient, each indicative of contribution thereto of the individual cylinders, and an observer means which estimates the air/fuel ratios of the individual cylinders of the engine based on the mathematical model.

29. A system for controlling air/fuel ratios of individual cylinders of a multicylinder internal combustion engine connected to an exhaust pipe via an exhaust manifold constituting an exhaust system of the engine, comprising:

an air/fuel ratio sensor installed at said exhaust system of the engine;

engine operating condition detecting means for detecting operating conditions of the engine;

a fuel injector for injecting fuel based upon a determined fuel injection quantity; and control means for controlling said fuel injector based upon outputs from the air/fuel ratio sensor and the engine operating condition detecting means, said control means including a) detection means for receiving an output of said air/fuel ratio sensor to determine an air/fuel ratio at a confluence point;

b) estimating means for estimating the air/fuel ratios of the individual cylinders of the engine based on an exhaust gas behavior describing means which describes behavior of the exhaust system at the confluence point;

c) fuel injection quantity determining means for determining a fuel injection quantity to be supplied to the engine based on at least one of a base fuel injection value and the estimated air/fuel ratios of the individual cylinders;

d) discriminating means for discriminating if the detected engine operating condition is in a predetermined region; and e) discontinuing means for causing the estimating means to discontinue the estimation of the air/fuel ratios when the detected engine operating condition is discriminated to be in the predetermined region whereby an air/fuel ratio, which may be erroneous, is not estimated in said predetermined region.

30. A system according to claim 29, wherein said exhaust gas behavior describing means includes:

a mathematical model having a recurrence formula based upon the air/fuel ratio at the confluence point being expressed as a sum of products of past firing histories of the individual cylinders and a weighting coefficient, each indicative of contribution thereto of the individual cylinders, and an observer which estimates air/fuel ratios of the individual cylinders of the engine based on the mathematical model.

31. A system for controlling air/fuel ratios of individual cylinders of a multicylinder internal combustion engine connected to an exhaust pipe via an exhaust manifold constituting an exhaust system of the engine, the system comprising:

an air/fuel ratio sensor installed at said exhaust system of the engine;

a fuel injector for injecting fuel based on a determined fuel injection quantity; and a control means for controlling the fuel injector based upon an output of the air/fuel ratio sensor, said control means including a) a detection means for receiving an output of said air/fuel ratio sensor to determine an air/fuel ratio at a confluence point;

b) estimating means for estimating the air/fuel ratios of the individual cylinders of the engine based on the output of an exhaust gas behavior describing means which describes behavior of the exhaust system at the confluence point;

c) fuel injection quantity determining means for determining the fuel injection quantity to be supplied to the engine based on at least one of a base fuel injection value and the estimated air/fuel ratios of the individual cylinders;

d) air/fuel ratio feedback control loop for correcting the fuel injection quantity using a feedback factor such that the air/fuel ratios in the individual cylinders converge to at least one of a desired air/fuel ratio and a desired value, wherein the desired air/fuel ratio is input to the estimating means as another input whereby highly accurate air/fuel ratios are estimated even when the desired air/fuel ratio changes frequently.

32. A system according to claim 31, wherein said exhaust gas behavior describing means includes:

a mathematical model having a recurrence formula based upon the air/fuel ratio at the confluence point being expressed as a sum of products of past firing histories of the individual cylinders and a weighting coefficient, each indicative of contribution thereto of the individual cylinders, and an observer means which estimates air/fuel ratios of the individual cylinders of the engine based on the mathematical model.

33. A system for controlling air/fuel ratios of individual cylinders of a multicylinder internal combustion engine connected to an exhaust pipe via an exhaust manifold constituting an exhaust system of the engine, said system comprising:

an air/fuel ratio sensor installed at a confluence point of the exhaust system of the engine;

engine operating condition detection means for detecting operating conditions of the engine;

a fuel injector for injecting fuel based on a determined fuel injection quantity; and control means for determining the fuel injection quantity based upon outputs of the air/fuel ratio sensor and the engine operating condition detecting means, said control means including a) a detection means for receiving an output of said air/fuel ratio sensor to determine an air/fuel ratio at the confluence point;

b) estimating means for estimating the air/fuel ratios in the individual cylinders from an exhaust gas system behavior deriving means which derives behavior of the exhaust system;

c) fuel injection quantity determining means for determining a fuel injection quantity to be supplied to the engine based on at least one of a base fuel injection value and the estimated air/fuel ratios of the individual cylinders; and d) discriminating means for discriminating whether the detected engine operating condition is in a predetermined region;

wherein said estimating means discontinues estimating the air/fuel ratios of the individual cylinders when the detected engine operating condition is discriminated to be in the predetermined region whereby a possibly erroneous air/fuel ratio is not estimated in said predetermined region.

34. A system according to claim 33, wherein said exhaust gas behavior deriving means includes:

a mathematical model having a recurrence formula based upon the air/fuel ratio at the confluence point being expressed as a sum of products of past firing histories of the individual cylinders and a weighting coefficient, each indicative of contribution thereto of the individual cylinders, and an observer which estimates air/fuel ratios of the individual cylinders of the engine based on the mathematical model.

35. A system for controlling air/fuel ratios of individual cylinders of a multicylinder internal combustion engine connected to an exhaust pipe via an exhaust manifold constituting an exhaust system of the engine, said system comprising:

an air/fuel ratio sensor installed at a confluence point of the exhaust system of the engine;

fuel injector for injecting fuel based on a determined fuel injection quantity; and control means for determining the determined fuel injection quantity, said control means including a) detection means for receiving an output of said air/fuel ratio sensor to determine and air/fuel ratio at the confluence point;

b) estimating means for estimating the air/fuel ratios of the individual cylinders from an exhaust gas system behavior deriving means which derives behavior of the exhaust system; and c) fuel injection quantity determining means for determining a fuel injection quantity to the supplied to the engine based on at least one of a base fuel injection value and the estimated air/fuel ratios of the individual cylinders;

wherein a desired air/fuel ratio is input to the estimating means as another input whereby highly accurate air/fuel ratios are estimated even when the desired air/fuel ratio changes frequently.

36. A system according to claim 35, wherein said exhaust gas behavior deriving means includes:

a mathematical model having a recurrence formula based upon the air/fuel ratio at the confluence point being expressed as a sum of products of past firing histories of the individual cylinders and a weighting coefficient, each indicative of contribution thereto of the individual cylinders, and an observer which estimates air/fuel ratios of the individual cylinders of the engine based on the mathematical model.

37. A method for controlling air/fuel ratios of individual cylinders of a multicylinder internal combustion engine connected to an exhaust pipe via an exhaust manifold constituting an exhaust system of the engine, the method comprising the steps of:

detecting operating conditions of the engine;

detecting the exhaust gas using an air/fuel ratio sensor installed at the exhaust system of the engine;

determining an air/fuel ratio at a confluence point based upon the air/fuel ratio sensor;

discriminating if the detected engine operating condition is in a predetermined region;

estimating the air/fuel ratios of the individual cylinders of the engine based on an output of an exhaust gas behavior describing means which describes behavior of the exhaust system at the confluence point, and discontinuing the estimation of the air/fuel ratios when the detected engine operating condition is discriminated to be in the predetermined region;

determining a fuel injection quantity to be supplied to the engine based on at least one of a base fuel injection value and the estimated air/fuel ratio of said individual cylinders;

injecting fuel to a fuel injector based on the fuel injection quality; and controlling the fuel injector based upon the fuel injection quantity whereby an air/fuel ratio, which may be erroneous, is not estimated in said predetermined region.

38. A method for controlling air/fuel ratios of individual cylinders of a multicylinder internal combustion engine connected to an exhaust pipe via an exhaust manifold to constitute an exhaust system of the engine, the method comprising the steps of:

detecting the exhaust gas using an air/fuel ratio sensor installed at said exhaust system of the engine;

determining an air/fuel ratio at a confluence point based upon an output of said air/fuel ratio sensor;

estimating the air/fuel ratios of the individual cylinders of the engine based on the output of an exhaust gas behavior describing means which describes behavior of the exhaust system at the confluence point and based upon a desired air/fuel ratio;

determining the fuel injection quantity to be supplied to the engine based on at least one of a base fuel injection value and the estimated air/fuel ratio said the individual cylinder;

injecting fuel to a fuel injector based on the determined fuel injection quality; and correcting the fuel injection quantity using a feedback factor such that the air/fuel ratios in the individual cylinders converge to at least one of the desired air/fuel ratio and a desired value;

controlling the fuel injector based upon the corrected fuel injection quantity whereby highly accurate air/fuel ratios are estimated even when the desired air/fuel ratio changes frequently.

39. A method for controlling air/fuel ratios of individual cylinders of a multicylinder internal combustion engine connected to an exhaust pipe via an exhaust manifold constituting an exhaust of the engine, the method comprising the steps of:

detecting the exhaust gas at a confluence point of the exhaust system of the engine using an air/fuel ratio sensor;

detecting operating conditions of the engine;

determining an air/fuel ratio at the confluence point based upon the output of the air/fuel ratio sensor;

discriminating whether the detected engine operating condition is in a predetermined region;

estimating the air/fuel ratios and the individual cylinders from an exhaust gas behavior deriving means which derives behavior of the exhaust system, and discontinuing estimating the air/fuel ratios of the individual cylinders when the detected engine operating condition is discriminated to be in the predetermined region;

determining a fuel injection quantity to be supplied to the engine based on at least one of a base fuel injection value and the estimated air/fuel ratios of the individual cylinders; and injecting fuel based on the determined fuel injection quantity, whereby a possibly erroneous air/fuel ratio is not estimated in the predetermined region.

40. A method for controlling air/fuel ratios of individual cylinders of a multicylinder internal combustion engine connected to an exhaust pipe via an exhaust manifold constituting an exhaust system of the engine, the method comprising the steps of:

detecting the exhaust gas at a confluence point of the exhaust system of the engine using an air/fuel ratio sensor;

determining an air/fuel ratio at the confluence point based upon the output of the air/fuel ratio sensor;

estimating the air/fuel ratios in the individual cylinders from a) an exhaust gas behavior deriving means which derives behavior of the exhaust system and b) a desired air/fuel ratio;

determining a fuel injection quantity to be supplied to the engine based on at least one of a base fuel injection value and the estimated air/fuel ratios of the individual cylinders;

inputting the desired air/fuel ratio which is used for estimating the air/fuel ratios of the individual cylinders; and injecting fuel based on the determined fuel injection quantity, whereby highly accurate air/fuel ratios are estimated even when the desired air/fuel ratio changes frequently.

* * * * *